US012773613B2

(12) United States Patent
Gao

(10) Patent No.: US 12,773,613 B2
(45) Date of Patent: Oct. 27, 2026

(54) GOLF PRACTICING TENT WITH OUTER RECEIVER

(71) Applicant: Xinwei Gao, North York (CA)

(72) Inventor: Xinwei Gao, North York (CA)

( * ) Notice: Subject to any disclaimer, the term of this patent is extended or adjusted under 35 U.S.C. 154(b) by 525 days.

(21) Appl. No.: 17/467,959

(22) Filed: Sep. 7, 2021

(65) Prior Publication Data

US 2023/0076144 A1 Mar. 9, 2023

(51) Int. Cl.

| | |
|---|---|
| ***A63B 69/36*** | (2006.01) |
| ***A63B 71/02*** | (2006.01) |
| ***A63B 71/06*** | (2006.01) |
| ***E04H 15/02*** | (2006.01) |
| ***E04H 15/42*** | (2006.01) |

(52) U.S. Cl.

CPC ..... *A63B 69/3623* (2013.01); *A63B 71/022* (2013.01); *A63B 71/06* (2013.01); *E04H 15/02* (2013.01); *E04H 15/42* (2013.01); *A63B 2071/0691* (2013.01); *A63B 2210/50* (2013.01); *A63B 2214/00* (2020.08); *A63B 2220/05* (2013.01)

(58) Field of Classification Search

CPC ..... A63B 69/3623; A63B 71/022

See application file for complete search history.

(56) References Cited

U.S. PATENT DOCUMENTS 4,127,267 A * 11/1978 Bay ..... A63B 63/00 473/421
5,088,740 A * 2/1992 Peterson ..... A63B 63/00 473/421
6,045,466 A * 4/2000 Suess ..... A63B 67/002 473/439
7,494,128 B2 * 2/2009 Byram ..... F41J 1/10 273/394
8,894,511 B2 * 11/2014 Lore ..... A63B 69/3623 273/400
2003/0125121 A1 * 7/2003 Rhee ..... A63B 63/00 473/197
2006/0068943 A1 * 3/2006 Cho ..... A63B 69/002 473/400
2007/0000533 A1 * 1/2007 Tseng ..... E04H 15/04 135/90
2013/0190109 A1 * 7/2013 Rigoli ..... A63B 63/00 473/478

(Continued)

*Primary Examiner* — Eugene L Kim
*Assistant Examiner* — Christopher Glenn

(57) ABSTRACT

The present disclosure provides a design for an instant multifunctional golf practicing tent with one or more outer receiving nets for achieving a significantly larger golf ball receiving range with a smaller tent footprint, which improves adaptability and portability. It features a collapsible frame structure with an instant hub for easy assembling or disassembling the golf practicing tent; at least one receiver or receiving net located outside of the tent with a large receiving area covering the front of the tent; corner pockets are located at the base of the front opening for stopping the ball from bouncing back to hurt people and properties. Other embodiments include: an additional inner or outer receiving net for added safety; a tilted floor panel for easy ball retrieval; floor distance markings, net range maps, and a tracking device for tracking performance and simulating results in real golf courses; multiple functionalities as different shelter types.

20 Claims, 8 Drawing Sheets

(56) References Cited

U.S. PATENT DOCUMENTS

| | | | | |
|---|---|---|---|---|
| 2015/0217185 | A1* | 8/2015 | Cranford | A63F 3/0423 273/355 |
| 2016/0192783 | A1* | 7/2016 | Kelly | E04H 15/50 135/96 |
| 2016/0289998 | A1* | 10/2016 | Huang | E04H 15/48 |
| 2017/0173431 | A1* | 6/2017 | Rigoli | A63B 63/004 |
| 2017/0189773 | A1* | 7/2017 | Cho | A63B 63/00 |

* cited by examiner (a)

(b)

(c)

(a)

(b)

GOLF PRACTICING TENT WITH OUTER RECEIVER

FIELD

The present disclosure relates to the field of portable utility products in sports, method of golf practicing, instant tent, and, especially, an instant golf practicing tent with an outer receiver that aids training for golf skills at any locations where an actual golf course or facility is not available.

BACKGROUND

Golf is well known and enjoyed by multitudes of people around the world. It's very easy to practice chipping, pitching, and all the short shots without having access to a driving range. However, finding the space to master your long shots makes things a little more complicated. There is a way around this problem by using a golf practicing tent with a receiving net. It is well known in the golf industry to practice golf by hitting a golf ball directly into a golf practicing tent. This enables practicing long shots using irons and woods without the need of a golf course and the risk of damaging anything in the surrounding area. For these golf practicing tents to be portable, some such tents are supported by a retractable and collapsible metal frame. Such tents use panels that are generally comprised of a taut mesh or net. These advantages make the golf practicing tent an ideal way for people to improve their golfing skills.

Existing retractable and collapsible practicing tents typically have a receiver to catch an incoming golf ball. Hereinafter, the term 'receiver' is interchangeable with 'receiving net'. Such receiving nets are generally inside the golf practicing tent to slow down the speed of the ball and prevent damage to the tent's structure from incoming golf balls, especially the tent's back and side panels. However, one major problem of all existing designs is that the receiving net is limited in size, being only as large as the tent's interior space. This becomes an issue if a user ends up missing the golf tent entirely since the ball may end up hitting another person, property, or anything else in the surrounding area. Hereinafter, the term 'user' implies someone who sets up or takes down a tent, as well as someone who swings the golf ball towards a net or tent. So, if a user wants a bigger striking or receiving area for practicing golf, they would need to get a bigger tent. As a result, the total weight of both the tent and receiving net increases, making it inconvenient to set up and carry around. The increased size may also affect how the tent and the net are folded up. One possible way to mitigate this is to add extension panels to the sides of the tent so that the main tent itself does not increase in weight. However, the extension panel cannot add a height dimension to the tent and golf ball receiver. There is a need to have a larger receiving area while keeping the rest of the golf practicing tent as small and light as possible.

Another problem associated with existing retractable/collapsible practicing tents or nets is that it takes much muscular strength and difficulty to assemble and disassemble if one wants to erect the collapsible practicing tent quickly. In that case, another problem is that one must be skilled in assembling different parts into an assembled practicing tent without assistance from instruction manuals. Even if the instruction manual is well written, it takes time to assemble numerous parts into an erect practicing tent. If the instruction manual is not well written, it results in frustration and a longer assembly/disassembly period for users. Existing retractable/collapsible nets are generally tricky to fold properly. It's a lot like folding a map. There are many ways to fold a map, but only one way gets all the creases to line up properly and look decent instead of a big mess. The multiplicity of parts and the skill required in assembly/disassembly is an irritant for many golf enthusiasts who want to practice.

Another less appreciated factor that collapsible-practice-net users deal with the hazard associated with using these structures. According to a study, general injuries during assembly/disassembly and strain injuries from tent handling are among the top eighteen hazard patterns associated with tents. Injuries from golf balls are also common. Another hazard is related to that golf balls are small, heavy, and can cause injuries when in motion. So, a golf ball falling from great heights or with great speed can cause the potential severity of any injury caused. For example, any golf ball entering the tent may bounce back at the user. If the golf ball misses the user entirely, it may end up injuring another person or animal. Golf balls in motion can also cause potential damage to other objects and even to the existing retractable/collapsible practicing tents themselves. If the user hits a golf ball with a large force into the tent, the receiving net may not be enough to stop or slow down the incoming golf ball. The ball would go through and may end up piercing one of the panels of the golf practicing tent. Therefore, a way to increase the strength and durability of the golf practicing tent while expanding its receiving range is also required.

The third undesirable aspect of the existing practicing tents is their single functionality. If you want to take a camping trip and play golf along with your vocation, you might not bother to carry two pieces of equipment—a camping tent and a golf practicing tent—in your luggage. Why can they not be combined into one simple golf practicing tent?

Existing collapsible practicing tents usually have a single net to stop the golf ball. It is not unusual for such practicing tents to rupture due to the ball's impact, resulting in property damage and/or minor to fatal injuries. Thus, there is an unmet need to improve existing collapsible practicing tents to prevent property damage, injuries, and lost lives.

Furthermore, a user cannot easily measure and evaluate their own performance and progress when practicing golf using the existing practicing tents. Such tents typically have a bullseye to help the user aim the ball, but that is usually about it. There is no way to relate your current practice with your real performance in an actual golf course. There are other golf practice tools available for improving one's performance in golf, but they are generally not portable, harder to set up, and they come with their own drawbacks.

Take the impact screen, for example. The impact screen is mainly a large fabric sheet designed to absorb the impact of an incoming golf ball in the same way as a practicing tent. However, it is generally cumbersome to deal with. Suppose the user wants to have a better receiving range in case they entirely miss the target. In this case, a larger impact screen is required. Suppose that the user wants to do a hard golf swing. A stronger impact screen would be required to withstand the impact of the golf ball, which also means a heavier screen. Impact screens are also inconvenient to set up and take down, so they are usually set up in one place, like an indoor room. Even when the impact screen is successfully set up, it is noisy on impact, and they suffer from bounce-back problems. The user may be hit by a golf ball bouncing back at them, causing potential harm or injuries.

Golf simulators are another option for improving one's golf performance. Such simulators can be projector-based, often working alongside an impact screen. Additionally, golf enthusiasts can also choose sonic-sound-based, radar-based, optical-sensor-based, and camera-based systems. However, high costs, lack of outdoor use functionality, lack of portability, and the need for tech-savviness are some of the many challenges associated with these golf simulators.

The present disclosure provides a design for an instant outward-capturing golf practicing tent with an outer receiver. The golf practicing tent improves upon the following aspects: (1) a bigger, i.e., wider and higher, receiving range to catch incoming golf balls for better and safer golf practicing; (2) increased strength for receiving high-speed golf balls from hard swings, which increases safety for the user, tent, and surroundings; (3) better performance evaluation, measuring, and tracking; (4) improved convenience for setting up and folding down due to the instant hub mechanism; (5) improved space utilization and storage and adaptability for indoor and outdoor use due to the tent being smaller in size.

SUMMARY

The present disclosure presents a design, method, and apparatus for an instant multifunctional golf practicing tent with one or more outer receivers. The purpose is to provide a significantly larger golf ball receiving range with a smaller tent footprint; therefore, a better and convenient way to improve a user's golfing skills and have an experience nearly equivalent to that of an actual golf course at any convenient location. The present disclosure includes the following major aspects of the invention: (1) at least one wider and higher receiving net located outside of the golf practicing tent and covering an area much larger than the entire front of the golf practicing tent. This allows the tent structure to have a smaller footprint while having the same or better performance in receiving incoming golf balls; (2) a supplementary inner or second outer receiving net to further ensure that incoming golf balls can be received safely so to better protect the user, tent, and surroundings; (3) stopping pockets at the front opening for additional safety; (4) tilted floor for easy ball retrieval and connection; (5) golfing performance measurement, evaluation, simulation, and tracking features comprising floor distance marks, range maps on the receiving nets, and a tracking device such as a high-speed camera; (6) a mechanism and method for convenient and instant assembly and disassembly; (7) a portable form factor when folded up due to the smaller footprint; (8) multiple functions as golf practicing, camping tent, and shelter of many other types.

The golf practicing tent of the present disclosure comprises multiple sections, which include a ceiling panel, a floor panel, two opposing side panels, a back panel, and a front opening. A collapsible frame structure supports the tent's structure, which comprises multiple components: an instant hub enables quick assembly and disassembly of the instant golf practicing tent with minimal effort; a series of base and telescopic poles—each pair of which are connected by a connecting joint member. Canopy fasteners connect the tent to the frame structure. Triangular-shaped stopping pockets are installed at the base of the tent's front opening. The pockets prevent balls that enter the tent from flying out. In other words, the pockets increase the safety of the user and surroundings, contributing to the tent's overall strength.

The instant hub at the center of the frame structure comprises an umbrella-head base cap with a telescoping cylinder underneath and multiple hub poles radially distributed along the base cap's diameter. The hub poles are connected to the base and net holding poles at the top of the frame structure. There are also moving poles radially distributed along the instant hub's locking member, which are connected to the hub poles and influence their movement during assembly or disassembly. The instant hub may be opened/unfolded or closed/folded with a string/cable pulley or a spring-loaded mechanism. Once the cable pulley or the spring-loaded mechanism is activated, the instant hub can be locked in place with a locking member that guides the extension/revealing or retraction/concealing of the instant hub's cylinder. Additionally, the hub poles and moving poles can expand outward or retract inward; this affects the tent's form factor during tent assembly and disassembly. Thanks to the ease of use, the instant hub enables the assembly and disassembly of the golf practicing tent in a quick manner with minimal effort.

In one embodiment, the preferred embodiment, at least a single golf ball receiving net is located outside of the tent, supported by the instant hub's two front net holding poles via two receiving net fasteners. This net reduces a golf ball's kinetic energy and changes its direction to contain the ball within the tent or stop the ball in front of the net. As the net is outside the tent, the tent can be made with a much smaller footprint. More importantly, the net is not confined by the tent's size and can, therefore, have a larger—both wider and higher area: the top end of the outer receiving net is coupled to the two front net holding poles via receiving net fasteners; the side ends of the outer receiving net cover the front opening and two front telescopic poles; the bottom end of the receiving net is situated loosely along the floor. The outer receiving net is spaced apart from the front opening of the tent. The outer net may also be detached from the two front net holding poles of the instant hub and rolled up to be stored separately from the rest of the tent. To balance the weight of the receiving net(s) hanging outside of the tent, extra weight is added to the back panel or back side of the floor panel.

In other alternative embodiments, an additional outer or inner net may also be used to further slowdown incoming golf balls to prevent damage to the back panel. In other words, it would ensure that incoming golf balls can be received safely under the worst case, protecting the user, tent structure, and the surroundings. In the case of the additional inner receiving net, it would be held up by two parallel interior receiving net hanging rods above the side panels, which are linked to the front and rear connecting joint members on their respective sides of the tent.

In another alternative embodiment, the floor panel is tilted at a downward angle so that the user can easily retrieve golf balls that enter the tent. The floor panel section near the back is raised, modifying the back panel size and canopy fastener positions. A ball hitting the tent slides down the tilted floor panel so that the ball slides toward the user. The tilted floor can work in combination with the stopping pockets to contain golf balls behind the front bottom corners of the tent. This way, the golf balls do not roll away too quickly and can be collected easily without going inside the tent structure.

An alternative embodiment of the present disclosure may incorporate features for providing performance evaluation, measurements, progress tracking, and game simulation. Such features enable the user to track how their performance would be at an actual golf course. In one of such embodiments, there are distance markings on the floor panel and range markings on the receiving net(s). The floor panel has floor distance marks, or simply floor marks to show a corresponding distance a ball might have traveled if shot on an actual golf course. In another embodiment, the receiving net(s) has a map with equal distance contours for target practice, distance measuring, and/or further indicating different golf course environments, e.g., direction and distance from the hole, terrain type, weather, etc. In yet another embodiment, a tracking device, such as one or more high-speed cameras, is used to monitor and/or record the trajectory of the ball hitting the receiving net(s).

The golf practicing tent can be folded up into a portable form factor thanks to a unique instant hub. The panel segments of the tent itself can fold neatly into itself. The instant hub can contract the base and front net holding poles to a closed, folded state. The telescopic poles supporting the tent can either be separated from the base poles. Alternatively, the telescopic and base poles can pivot about their respective connecting joint members in a folder manner. The frame structure of the golf practicing tent also has extension members that allow adjustment to the lengths of the extension poles as needed. Additional telescoping joint members can be used to further retract the telescopic beams into the extension pole. In addition, the outer receiving net can be detached and folded up separately from the rest of the tent.

The golf practicing tent in the present disclosure can be used as a means to play golf in any environment and location; however, it can also be used as a multi-functional camping tent, beach tent, and/or other vocational shelters. To achieve this, the floor panel and receiving net can be folded or rolled up.

By using the tent, the overall experience of playing golf in any environment is improved. The present disclosure does this by achieving the following: (1) a bigger, i.e., wider and higher, receiving range to catch incoming golf balls thanks to the receiving net(s); (2) increased strength for receiving high-speed golf balls from hard swings thanks to the receiving net(s) and stopping pockets; (3) better able to improve one's golf swing as a result of better performance evaluation, measuring, and tracking thanks to the range map, floor mark, and tracking features; (4) improved convenience for assembling or disassembling the instant golf practicing tent thanks to the instant hub mechanism; (5) improved space utilization and storage and adaptability for indoor and outdoor use thanks to the portable form factor and the tent's multiple functions.

BRIEF DESCRIPTION OF THE DRAWINGS

The accompanying drawings, which are included to provide a further understanding of the invention and are incorporated in and constitute a part of this application, illustrate embodiment(s) of the present disclosure and, together with the description, serve to explain the principle of the invention. For simplicity and clarity, the figures of the present disclosure illustrate a general manner of construction of various embodiments. Descriptions and details of well-known features and techniques may be omitted to avoid unnecessarily obscuring the discussion of the present disclosure's described embodiments. It should be understood that the elements of the figures are not necessarily drawn to scale. Some elements' dimensions may be exaggerated relative to other elements for enhancing the understanding of described embodiments. In the drawings.

DETAILED DESCRIPTION

Figure 1:
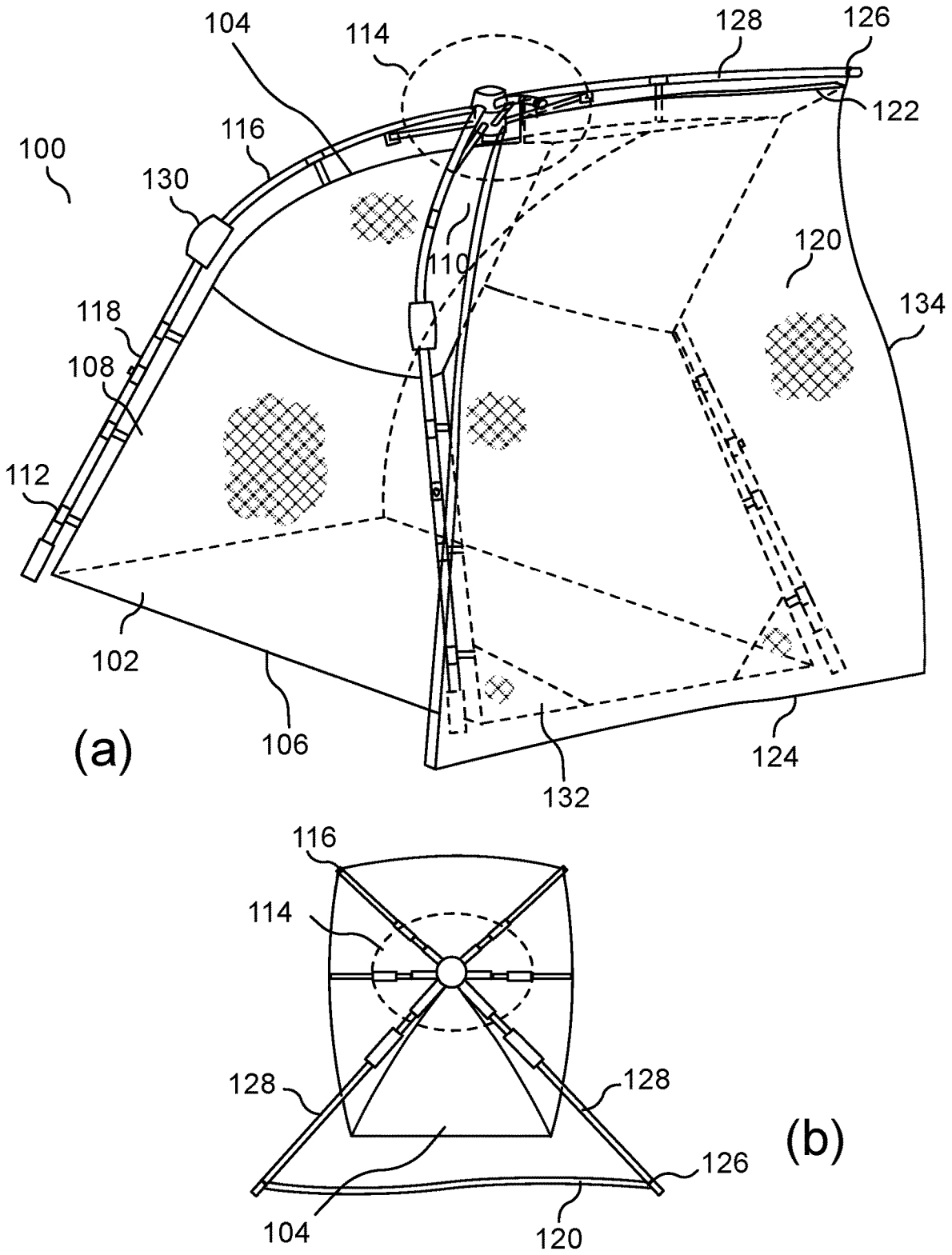
FIG. 1 illustrates perspective and top views of a preferred embodiment of the present disclosure comprising an instant multi-functional golf practicing tent with a single outer receiver net.

The present disclosure presents a design for an instant multifunctional golf practicing tent with at least one outer receiver. Hereinafter, the term 'instant multifunctional golf practicing tent' is interchangeable with 'instant golf practicing tent', 'golf practicing tent', 'golf tent', 'instant tent', and 'tent'. Various examples of the present invention are shown in the figures. However, the present invention is not limited to the illustrated embodiments. In the following description, specific details are mentioned to give a complete understanding of the present disclosure. However, it may likely be evident to a person of ordinary skill in the art; hence, the present disclosure may be applied without mentioning these specific details. The present disclosure is represented as few embodiments; however, the disclosure is not necessarily limited to the particular embodiments illustrated by the figures or description below.

The language employed herein only describes particular embodiments; however, it is not limited to the disclosure's specific embodiments. The terms "they", "he/she", or "he or she" are used interchangeably because "they", "them", or "their" are considered singular gender-neutral pronouns. The terms "comprise" and/or "comprising" in this specification are intended to specify the presence of stated features, steps, operations, elements, and/or components; however, they do not exclude the presence or addition of other features, steps, operations, elements, components, or groups.

Unless otherwise defined, all terminology used herein, including technical and scientific terms, have the same definition as what is commonly understood by a person of ordinary skill in the art, typically to whom this disclosure belongs. It will be further understood that terms, such as those defined in commonly used dictionaries, should be interpreted as having the same meaning as defined in the context of the relevant art and the present disclosure. Such terms should not be construed in an overly strict sense unless explicitly described herein. It should be understood that multiple techniques and steps are disclosed in the description, each with its benefit. Each technique or step can also be utilized in conjunction with a single, multiple, or all of the other disclosed techniques or steps. For brevity, the description will avoid repeating each possible combination of the steps unnecessarily. Nonetheless, it should be understood that such combinations are within the scope of the disclosure. Reference will now be made in detail to some embodiments of the present invention, examples of which are illustrated in the accompanying figures.

The golf practicing equipment/tent comprises multiple sections, which include a ceiling panel, a floor panel, two opposing side panels, a back panel, and a front opening. The tent is supported by a collapsible frame structure comprising of many components: an instant hub enables quick assembly and disassembly of the instant tent with minimal effort; a series of base poles connected to the hub poles radially distributed along the diameter of the instant hub's base cap; a series of vertical telescopic poles connected to the base poles via connecting joint members. Extension poles cover the bottom portion of the telescopic poles, with the latter type expanding from or retracting into the former type. Each extension pole and telescopic pole pairing is separated by a connecting joint member in the middle with a button that controls the extension or retraction of the respective telescopic pole. There are also extensions members at the base of the extension poles and, by extension, the tent's frame structure; these members allow the extension poles to extend or retract. The tent itself has several canopy fasteners distributed along the tent's edges, which connect the frame structure to the tent's structure.

The present disclosure has a few notable aspects. In the first aspect of the present disclosure, there is at least one receiving net outside of the front side of the tent, supported by two modified base poles via receiving net fasteners. Hereinafter, these 'modified base poles' are called 'front net holding poles'. This net is generally designed to attenuate the kinetic energy of incoming golf balls, weakening them upon impact so that they can land on the net itself or be contained inside the tent without damaging any of the panels (e.g., back panel). Hereinafter, the term 'ball' specifically implies a 'golf ball', and can be used interchangeably. When the tent structure is set up, each front net holding pole is angled at a high upward angle compared to the rest of the base poles. The two front net holding poles are also angled away from each other. Such adjustments allow for a wider and higher net to be held in front of the golf practicing tent since it is not constrained by the tent's size. Essentially, a larger hitting area and receiving range are achieved with the implementation of this outer receiving net. The golf practicing tent, on the other hand, can retain a smaller footprint. To balance the weight of the receiving net(s) hanging outside of the tent, extra weight is added to the back panel or back side of the floor panel.

In the second aspect of the present disclosure, a supplementary receiving net can be used with the main outer receiving net, which can take the following forms: an additional outer net behind the main outer receiving net; an inner receiving net inside the tent structure. Hereinafter, the term 'main outer receiving net' is interchangeable with 'first outer receiving net' when describing the tent with more than one receiving net. Both supplementary receiving net types aim to absorb additional impact from incoming golf balls in case they go through the first outer receiving net, preferably stopping it in place. Even if a particularly fast golf ball goes through this supplementary net, it will slow down the golf ball enough so that it does not strike the tent structure's interior (e.g., back panel) and cause damage. In the case of the inner receiving net, two parallel interior receiving net hanging rods are implemented above the side panels, which are linked to the front and rear connecting joint members on their respective sides. The inner receiving net is held up on the receiving net hanging rods via inner receiving net fasteners on the top edges of the inner receiving net.

In the third aspect of the present disclosure, the front side of the practicing tent has two triangular stopping pockets along the base of the tent's floor panel: one on each bottom corner of the tent's front opening. These pockets prevent golf balls that enter the instant golf practicing tent from flying out from the front side to hurt people or damage properties. The stoppers also act as barriers to stop golf balls from rolling out of the instant golf practicing tent, allowing a user to collect golf balls behind the front bottom corners of the tent without the need to enter the tent.

In the fourth aspect of the present disclosure, the tent floor can be tilted for a user to easily retrieve golf balls that enter the tent. The floor panel is angled upward, with the panel's side closest to the back panel raised upward, while the front side of the floor panel remains on the ground. Because of this, the back panel has a shortened height due to the floor panel's adjustment. Likewise, the canopy fasteners at the rear of the tent have their positions adjusted along the telescopic poles. Because of the tilted floor, golf balls entering the tent would slide down to the front of the tent. This can be used in combination with the stopping pockets to prevent golf balls from rolling away too swiftly.

In the fifth aspect of the present disclosure, some features allow for one to improve their performance in golf. Such features involve performance evaluation, measurements, simulation, and tracking. In one embodiment, there are marks on the floor panel, which are spaced out accordingly and indicate the distance a ball would travel if the user was playing at a real golf course. In another embodiment, at least one map with map region contours is printed on the receiving net(s). The map may be used as simple target practice and/or can indicate different information on the user's golf performance if they played on an actual golf course. Such information can include direction and distance from the hole, terrain type, weather, etc. In yet another embodiment, a tracking device, such as a high-speed camera, captures footage of the golf ball and its trajectory into the golf practicing tent. The tracking device can be deployed at different heights or angles to capture the trajectory of the golf ball accordingly. Once the shot is recorded, the information is processed using an instant or offline prediction software that translates the ball's trajectory into a simulated trajectory reflective of a shot taken at an actual golf course. Along with calculating the distance to the hole, the software also calculates any error between the desired distance and the actual distance so that the information is more reflective of real-world scenarios.

In the sixth aspect of the present disclosure, the golf practicing tent has a mechanism for instant assembly and disassembly. The instant hub at the center of the collapsible frame structure comprises an umbrella-head base cap, connected to multiple components: a telescoping cylinder that extends or retracts with the folding/closing or unfolding/opening of the instant hub; a locking member that pushes the one end of the cylinder, guiding its extension from or retraction into the instant hub's structure. The locking member also locks and secures the frame structure in an open or close state; a hub grip for the user to hold when assembling or disassembling the tent structure; a plurality of hub poles along the diameter of the base cap, which are connected to the two net holding poles and the other base poles; a series of moving poles radially distributed along the upper section of the locking member. The distal ends of the poles connect to the distal ends of the hub poles and pivot upward or downward about the locking member. As the moving poles pivot, they essentially push or pull the respective hub poles, causing the frame structure to transition between the expanded or retracted states; a string pulley or spring-loaded mechanism to assemble or disassemble the tent's collapsible frame structure. Hereinafter, the term 'string' is considered interchangeable with 'operating cable' and 'cable'. When the user wants to open or close the instant hub, they would first grab the hub grip. The user would then pull the cable to activate a pulley mechanism, which allows the user to move the hub grip and locking member to open or close the instant hub. Alternatively, the user can wind a spring inside the cylinder to close the hub or activate (unwind) the spring to open the hub. This causes the hub poles and associated base and front net holding poles to pivot upward (to unfold) or pivot downward (to fold in). At the same time, the hub grip and locking member move toward or away from the base cap, retracting or extending the telescoping cylinder. The method and mechanism provide an easy, convenient way to assemble or disassemble the golf practicing tent, meaning less time and muscular strength are required to assemble or disassemble the tent.

In the seventh aspect of the present disclosure, the golf practicing tent takes on a portable form factor. This aspect comprises a variety of features: (1) the tent panels can fold neatly into one another, allowing the tent to fold up into a small package; (2) when disassembling the tent, the instant hub transitions to a folded state, causing the hub poles to pivot downward, along with the associated base and front net holding poles. At the same time, the connected moving poles pivot upward. The poles are then in line with the instant hub's cylinder, locking member, and hub grip. The roof panel then collapses into a state to be folded with the other tent panels; (3) the joint members—the connecting and telescopic joint members—also allow parts of the frame structure to compress in size: the connecting members allow the base and telescopic poles to separate from each other to create a smaller form factor. Alternatively, the base and telescopic poles can pivot about their respective connecting joint members in a folding manner; the telescopic joint member allows each telescopic pole to retract into their respective extension pole with the click of a button on that joint member; (4) Each extension pole can slightly retract into an extension member at the base of the tent's frame structure; (5) the outer receiving net can be unfastened and detached from the front net holding poles to be folded and stored separately from the tent itself.

In the eighth aspect of the present disclosure, the golf practicing tent can serve multiple functions. Apart from its primary function, the tent can be set up to act as a type of shelter, such as a beach tent, picnic tent, camping tent, or any other type of vocational shelter. The floor panel can roll up to the back panel of the tent, leaving an open ground area for sand and grass. The outer receiving net can also roll up to the top near the front net holding poles, creating an open entrance to the tent itself; this may be used as a sort of weather protection in case the tent is set up in the rain. The telescopic poles can adjust their lengths to accommodate for uneven or sloped surfaces. First, the bottom portion of each telescopic pole is covered by an outer extension pole; a telescopic joint member divides the two pole types. By pressing a button on that joint member, a telescoping pole can extend from or retract into its respective extension pole. The extension poles can also adjust in length by extending or retracting into small extension members at the base of the tent's frame structure. Each telescopic pole can be adjusted independently to accommodate the sloped or uneven surface.

The instant multifunctional golf practicing tent addresses problems previously found in similar existing products. First, there is a larger (wider and higher) receiving range to catch incoming golf balls, thanks to the first aspect. As the outer receiving net is not restricted by the tent's interior size, the net can expand out to a higher and wider area while the tent itself retains a relatively small size. Instead, the outer receiving net's receiving range is influenced by the front net holding poles, particularly their upward angles and how spaced apart they are from each other. In any case, the tent itself can have a smaller footprint, and the outer receiving net can act as a larger hitting area. The receiving net can now be big enough to catch balls that completely miss the target, making the tent more forgivable to use. Furthermore, it helps prevent damage to anything in the surrounding area, such as properties, people, animals, or anything else in the surrounding area.

Second, the golf practicing tent as a whole has increased strength and durability when receiving high-speed golf balls thanks to the first, second, and third aspects of the present disclosure. The main outer receiving net is durable enough for absorbing the impact from a typical incoming golf ball, slowing down its kinetic energy. Furthermore, it is already spaced apart from the front opening of the tent structure. Because the ball slows down upon impact with the outer receiving net, the ball should not cause damage to the tent panels even if the ball goes through this net. But suppose that the user wants to hit the golf ball extremely hard, causing it to move faster. A supplementary inner or outer receiving net can absorb the additional impact from a hard-hitting golf ball, ensuring that the ball can be received safely without damaging anything in the surrounding area (e.g., the user, the tent itself, other surrounding objects, or people). Another reason for the increased durability is the incorporation of the stopping pockets at the base corners of the tent's front opening. If a golf ball goes through the net to touch the tent panels, the stopping pockets help prevent the ball from flying back to hurt the golfer.

Third, the user is able to improve their performance in golf thanks to the first and fifth aspects of the present disclosure. In the first aspect, the expanded receiving range of the outer receiving net makes practicing golf more forgiving since the ball can completely miss the tent's opening and still be stopped by the outer receiving net. This ensures that the ball does not hit anything or anyone in the surrounding area. In the fifth aspect, the marks on the floor panels are marked with numbers that are indicative of distances in a real golf course. The range map(s) can act as a simple target, but more importantly, it can indicate various factors in a real golf course like direction, hole type, various environments, topography, etc. In such a case, it trains the user to be adaptable to nearly all playing conditions. These two features help the user broadly see their progress in golf. For more precise progress tracking, the tracking device records the trajectory of a golf ball hitting the tent. With the help of simulation software, a simulated trajectory is generated, which lets the user get an accurate reading of what their strike would be like if playing on an actual golf course.

Fourth, improved convenience is achieved, primarily thanks to the sixth and seventh embodiment. The instant hub can be simply activated with the pull of a cable pulley or with the activation of a spring mechanism. This causes the instant hub to instantly fold inward to a more compact shape, where its hub poles and moving poles are in line with the instant hub's cylinder. The joint members, particularly the telescopic joint members, can be activated with a button to allow associated poles to retract or extend. Thanks to this mechanism, tent assembly can be done with minimal effort, meaning that less strength, attention, and installation steps are required to fully set up and take down the tent. Apart from a quick-start guide, no complicated instruction manual is needed. This convenience can also be seen with the fourth aspect of the present disclosure, the tilted floor. Because the floor panel is tilted, any ball entering the tent will hit the floor panel and slide down to the front of the tent. This way, the user does not have to go inside the tent to retrieve their ball. If they choose to, however, the tilted floor panel can work alongside the third aspect—the stopping pockets—to collect golf balls behind the front bottom corners of the tent. The stopping pockets not only store incoming balls in a convenient location but also ensure that the balls do not strike back at the user or fly away in another direction and cause damage in the surrounding area.

Fifth, there is improved space utilization, storage, and adaptability for indoor and outdoor use thanks to the first, seventh, and eighth embodiments. In the first aspect, the wide receiving net is on the outside of the tent. Since it is not influenced by the tent's size itself, the tent's structure can retain a small footprint while the user benefits from the larger receiving range. In other words, a tent does not need to be large in size to accommodate a bigger net, thanks to the outer receiving net's position outside the tent. This space utilization can also be seen when the instant hub transitions to a closed, folded state. This brings the hub poles, moving poles, and associated base and front net holding poles downward. Therefore, even with an extended cylinder, the hub folds into a neat package. When opening the instant hub, the cylinder retracts nicely into a compact state inside the instant hub's body. In addition to the instant hub, other aspects of the disassembly of the golf practicing tent also allow for more storage space. The tent itself can fold its panels in a way that makes one neat tiny package. The telescopic poles can detach from the base poles via their connection with the connecting joint members. Alternatively, the telescopic poles and base poles can pivot about the connecting joint member in a folding manner. The telescopic poles themselves can retract into extension poles for a smaller form factor with the press of the telescopic joint members' buttons (one per telescopic joint member). Finally, the outer receiving net can be detached from the front net holding poles to roll up and be stored separately. Alternatively, the folded-up outer receiving net can be packed with the other components to fit into one carrying bag. Because of this, the tent can be carried anywhere and set up to serve multiple functions, as seen in the eighth embodiment. For example, the golf practicing tent may be used as a beach tent, and the user wants to experience the sand at their feet. The golf practicing tent's floor panel can then be rolled up to meet with the back panel. Now, the user can experience the sand at their feet while being protected from the sun. The assembly at the beach is just one of many examples of the golf practicing tent's alternative uses. In another scenario, the tent is situated on an uneven or sloped surface. In such a case, telescopic poles can be adjusted in length by either retraction or extension from the extension poles via the telescopic joint members. Additionally, the adjustment of the lengths of the extension poles themselves can also be made at the base of the poles via extension from or retraction into the extension members. Each pole can be individually adjusted to accommodate such a surface.

FIG. 1 illustrates perspective and top views of a preferred embodiment of the present disclosure comprising an instant multi-functional golf practicing tent with a single outer receiver net. Sub-figure (a) illustrates a perspective view of the preferred embodiment of the instant multi-functional golf practicing tent (100) with a single outer receiver net (120). An outer receiver net is a receiving net that is installed outside the instant golf practicing tent. Looking at the sub-figure, the golf practicing tent (100) is positioned in a way where its front opening (110) is facing right. The golf practicing tent (100) comprises many panels: a roof panel (104) at the top, a floor panel (106) at the bottom, two opposing side panels (102), and a back panel (108) at the rear. There is a hollow front opening (110) at the front of the tent (100); the roof panel (104) has a triangular roof-life extension that shelters the front opening (110). The tent (100) also comprises two triangular stopping pockets (132) at the base of the front opening (110): one on the left side and one on the right side.

A collapsible frame structure provides structural support to the golf tent (100), consisting of a variety of components. At the top and center of the frame structure is an instant hub (114) connected to base poles (116) radially situated around the roof panel (104). The base poles (116) are further connected to telescopic poles (118) via connecting joint members (130). Two modified base poles are situated at the front of the tent (100) at different vertical and horizontal angles from the other base poles (116); these modified poles are the front net holding poles (128). The golf tent (100) has canopy fasteners (112) along the vertical edges of the tent's side panels (102) that connect to the frame structure and hold the tent (100) in place.

The golf practicing tent (100) has an outer receiving net (120) in front of the tent's (100) front opening (110) for accepting golf balls launched into the tent (100). The outer receiving net (120) is held up and secured in place by the front net holding poles (128) via receiving net fasteners (126) located on the left and ride corners of the outer receiving net's (120) top end (122). The lower end (124) of the outer receiving net (120) extends loosely toward the floor panel (106). The side ends (134) of the outer receiving net (120) extend laterally past the telescopic poles (118) on the left and right sides of the tent (100). Neither the lower end (124) or the side ends (134) are connected to the golf practicing tent (100).

Thanks to the new outer receiving net's (120) design, a larger receiving range can be achieved to catch incoming golf balls without requiring the tent itself to be as large. This makes it safer to use since the user is less likely to swing a ball and cause damage to something or someone in the surrounding area. Moreover, this net (120) design is also more forgiving since a golf ball can completely miss the front opening (110) of the tent (100), and the outer receiving net (120) can still catch the ball within reason. In a sense, the net's (120) design can also help with better evaluation and tracking of progress in the user's golf performance. The outer receiving net (120) is trapezoid-shaped in the present disclosure; however, the outer receiving net (120) can be any other shape like rectangular or circular in other embodiments. Modification to the two front net holding poles (128) may be required to ensure that the larger receiving range can still be achieved.

The support frame structure (114, 116, 118, 128, 130) may be composed of a variety of materials depending on the embodiment. Looking at the figure, the base poles (116) appear to slightly bend, aligning with the circular shape of the roof panel (104). The front net holding poles (128) also have a slightly bent shape in line with the circular edges of the roof panel's (104) front side. Therefore, such materials should be strong yet flexible; they may include plastic, polymers, aluminum, fiberglass, wood, or any other flexible materials.

The canopy fasteners (112) and receiving net fasteners (126) are shown as general representations. Depending on the embodiment, they may consist of handling strips, rope, strings, chains, buttons, snap-fit joints, or any other means of securing the tent (100) structure and the outer receiving net (120), respectively.

The stopping pockets (132) are shown at the bottom of the tent's (100) front opening (110), with two on each side. Thanks to this aspect, incoming golf balls are less likely to bounce and fly back at the user or anything else in the surrounding area. Therefore, they contribute to a safer playing environment for the user. The stopping pockets (132) also help improve convenience since they can catch balls entering the tent and hold them in a convenient location until the user retrieves them. In another embodiment, there can be two additional stopping pockets (132) at the top left and right sides of the tent's (100) front opening (110). As a result, an incoming golf ball is even less likely to fly back at the user or anything else in the surrounding area.

Sub-figure (b) illustrates a top view of the preferred embodiment of the instant multi-functional golf practicing tent (100) with a single outer receiver net (120). The sub-figure illustrates the two net holding poles (128) laterally angled away from each other, forming a wide V-shape. The outer receiving net (120) is held up by receiving net fasteners (126) that attach to the front ends of the net holding poles (128). Looking at the sub-figure, the net (120) is shown in between the net holding poles (128). The base poles (116) of the tent (100) are situated along the rear and sides of the roof panel (104).

The wide gap between the net holding poles (128) is a visual representation of how the outer receiving net (120) aspect achieves a wider receiving range. The outer receiving net's (120) width may also be applied to better evaluate, measure, and track their performance in order to improve since it is more forgiving to use.

Figure 2:
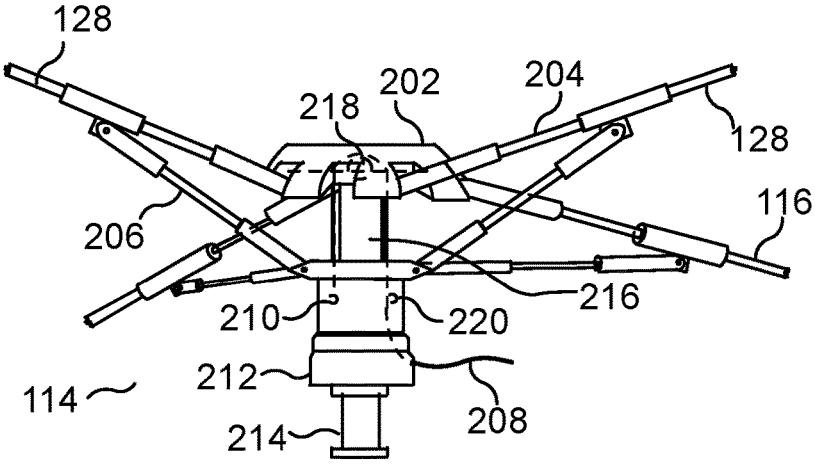
FIG. 2 illustrates front views of the instant hub with a string/cable pulley or spring mechanism and a semi-folded tent with a folded instant hub.
Figure 2:
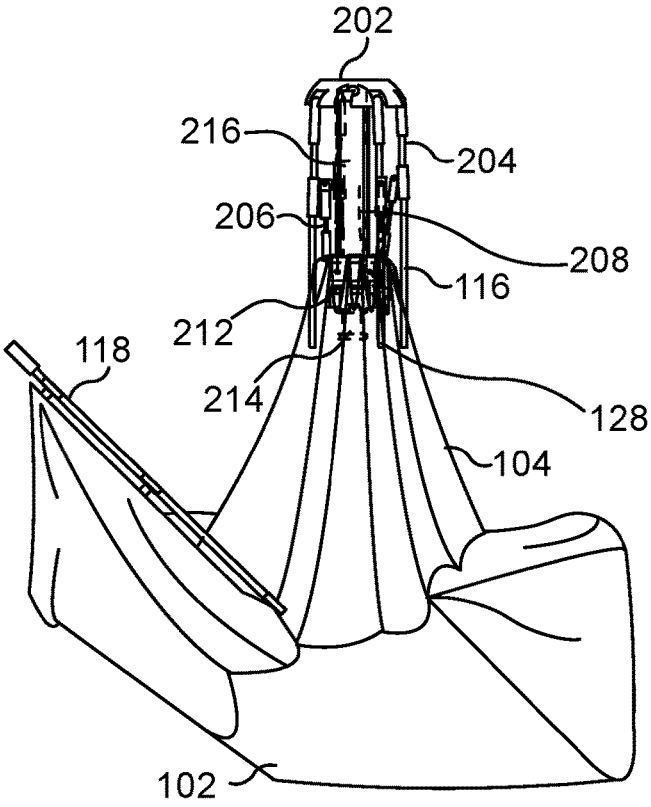
Figure 2:
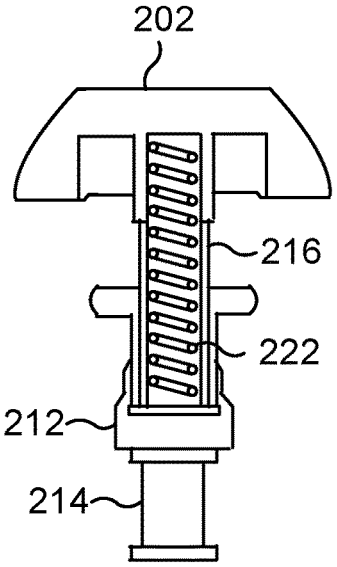

FIG. 2 illustrates front views of the instant hub with a string/cable pulley or spring mechanism and a semi-folded tent with a folded instant hub. Sub-figure (a) illustrates a partial front view of the instant hub (114) in a partially unfolded, open state. The instant hub (114) is generally shaped like an umbrella head. The hub (114) comprises a base cap (202) and a plurality of hub poles (204) radially distributed along the outer diameter of the base cap (202). A telescoping cylinder (216) is located below the base cap (202), which is a core component of the instant hub (114). The bottom of the instant hub (114) consists of a locking member (212) that makes up the majority of the instant hub's (114) bottom portion. A hub grip (214) is connected to the locking member (212) from below, allowing the user to grip and use the instant hub (114). The locking member (212) and hub grip (214) can move toward and away from the base cap (202). In this sub-figure, the locking member (212) and hub grip (214) move toward the base cap (202), deploying the instant golf practicing tent into an expanded, open position. Since the instant hub (114) is in a partially open state, the cylinder (216) is partially retracted. Likewise, the movement of the locking member (212) and hub grip (214) away from the base cap (202) folds the golf tent into a retracted, closed position. As the locking member (212) and hub grip (214) move away, the cylinder (216) extends.

A series of moving poles (206) are radially distributed along the upper portion of the locking member (212). The proximal end of each hub pole (204) is pivotally connected to the base cap (202), and the opposing distal end of each hub pole (204) is pivotally connected to a distal end of a corresponding moving pole (206). Similarly, the proximal end of each moving pole (206) is pivotally connected to the top portion of the locking member (212), and the distal end of each moving pole (206) is pivotally connected to the distal end of a corresponding hub pole (204). The distal ends of the hub poles (204) are connected to the proximal ends of the frame structure's poles (116, 128): two hub poles (204) at the rear are shown connected to the base poles (116); two hub poles (204) at the front are elevated at higher upward angles and are attached to the front net holding poles (128). It is obvious to those skilled in the art that the moving poles (206) associated with these two particular hub poles (204) would have a modified length to accommodate the associated hub poles (204). Because of this, the front net holding poles (128) can accommodate an outer receiving net that is taller than the tent structure itself; this will be shown further in FIG. 3.

The number of hub poles (204) distributed along the outer diameter of the base cap (202) may vary depending on the embodiment. There can be several hub poles (204); however, only a few are shown and discussed herein for brevity, clarity, and to avoid repetition.

In this embodiment, the instant hub (114) operates with a mechanism primarily consisting of a pulley (218, 220) mechanism and an operating cable/string (208). With this mechanism, the operating cable (208) is connected to or near a fixed end (210) within the locking member (212). In this sub-figure, the fixed end (210) is shown on the left side of the instant hub (114). The cable (208) loops upward around a fixed pulley (218) located within the base cap (202). The cable (208) then loops downward around a movable pulley (220), which is located within the locking member (212) and in line with the fixed end (210). After the second loop around the movable pulley (220), the operating cable (208) exits the locking member (212); this free end of the cable (208) is shown on the right side of the instant hub (114). The user then pulls on this free end of the cable (208) to launch the golf practicing tent.

The force from instantly launching the tent is split between the end of the cable (208) connected with the fixed end (210) and the cable's (208) free end. As a result, less strength is required to open the instant hub (114) compared to existing methods. In other embodiments, additional pulleys (218, 220) may be set up within the base cap (202) and locking member (212). This would make it even easier to set up the tent, taking even less strength to do so.

The cylinder (216) has telescoping segments that allow it to neatly retract into the instant hub's (114) body. This contributes to the instant hub's (114) simple mechanism for assembling and disassembling the tent structure since this extension or retraction is done along with all the movements of the other instant hub (114) components. Furthermore, the retraction of the cylinder (216) in this sub-figure helps achieve a small footprint that saves vertical space.

The operating cable (208) shown in this sub-figure is a general representation. In other embodiments, this cable (208) may be made of various materials and may include a hook or another attachment for the user to easily grab. The length of the cable (208) may also vary depending on the embodiment.

Sub-figure (b) illustrates a front view of a golf practicing tent and instant hub in a semi-folded form. A user would first grab the hub grip (214) at the bottom of the instant hub (114). The user then tugs on the operating cable (208) to activate the folding of the instant hub (114). Both the hub grip (214) and locking member (212) move away from the base cap (202). As the hub grip (214) and locking member (212) move, the telescoping segments of the cylinder (216) cause the component and, by extension, the instant hub (114) to vertically extend. At the same time, the hub poles (204), particularly their proximal ends, pivot downward about the base cap (202) to fold into the instant hub (114). The hub poles (204) line up with the lengths of the cylinder (216), locking member (212), and hub grip (214). This naturally causes the base poles (116) and the two front net holding poles (128) to fold inward as well, where the ends of such poles (116, 128) are pointing downward. The moving poles (206), particularly their proximal ends, pivot upward about the locking member (212). The distal ends of the moving poles (206) pivot about the distal ends of the hub poles (204). The moving poles (206) also line up with the lengths of the cylinder (216), locking member (212), and hub grip (214).

The telescopic poles (118) are detached from the base poles (116). The tent panels fold inward to the center, in line with the instant hub (114). The panels themselves can fold neatly into one another to make a small, portable form factor. Upon the closing of the instant hub (114), the roof panel (104) collapses into a foldable state. Looking at the sub-figure, the roof panel (104) appears to be folded like an umbrella. A side panel (102) is also laid out on the floor in this sub-figure, where another panel can fold on top of it.

In an alternative embodiment, the telescopic poles (118) do not detach from the base poles (116) when the frame structure is folded up. Instead, the telescopic poles (118) and base poles (116) can pivot about the connecting joint member in a folding manner.

Although the tent in this sub-figure is shown in a semi-folded state, it is still representative of the tent's portable form factor in how it folds up and how it achieves improved space utilization and storage. Looking at the sub-figure, the instant hub (114) with its components lined up neatly. The tent panels, e.g., side panel (102) and roof panel (104), are brought together in a neat, foldable manner. One noticeable absence in this sub-figure, however, is the outer receiving net. When packing up the tent, the outer receiving net can be detached from the front net holding poles (128) and fold up separately, allowing the tent and frame structure to easily fold up into a portable form factor. Naturally, the outer receiving net can also be stored separately from the other tent components, or it can be stored with the other tent components in one bag.

In an alternative embodiment, the tent panels, e.g., side panel (102) and roof panel (104), can have outer markers that can help the user fold the panels into a compact shape by indicating how the panels should be lined up.

Sub-figure (c) illustrates a front cross-sectional view of another embodiment of instant hub (114) with a spring mechanism consisting of a spring (222) situated inside the cylinder (216). One end of the spring (222) is connected to the base cap (202), and the opposite end is connected to the locking member (212) at the base of the hub (114). The user holds the hub grip (214) and locking member (212). The user then moves the locking member (212) and hub grip (214) away from the base cap (202), extending the cylinder (216). In one embodiment, the locking member (212) is locked in place when the instant golf practicing tent is in its fully folded position. The spring (222) moves to its extended state. When the user holds the hub grip (214), they can activate the locking member (212), causing the instant hub (114) to unlock. The spring (222) goes back to its compressed state after automatically exerting pressure; this pulls the base cap (202) and locking member (212) together to unfold the hub (114) and launch the tent.

The type of spring (222) used in the instant hub (114) can vary depending on the embodiment, including a compression spring, extension spring, or another suitable type of spring.

The instant hub (114) provides a mechanism and method for instant assembly and disassembly of the instant golf practicing tent. Thanks to that, improved convenience can be achieved since the entire process becomes easier with fewer steps. With one use of the cable (208) or spring (222), the frame structure—primarily the hub poles (204), moving poles (206), base poles (116), and net holding poles (128)—instantly expand out or fold in. Therefore, the user saves time since fewer actions need to be taken. The user may also not need a detailed instruction manual due to the simplicity of the tent's assembly/disassembly. Furthermore, the instant hub (114) does not need a great amount of strength to operate. A person with less muscular strength can easily operate the instant hub (114) and use it in the same manner as a person with regular strength.

The instant hub (114) can be locked at a plurality of positions, which leaves the tent in a partially folded or unfolded position based on the user's preference. In some alternative embodiments, the instant hub (114) automatically locks when it is fully expanded, fully folded, or whenever the locking member (212) is released by the user. In other alternative embodiments, the locking member (212) can operate with pull-to-release, twist-to-release, press-to-release mechanisms. In additional alternative embodiments, the locking member (212) may also lock into place with the cylinder (216) extended or retracted at a particular length using a push-pull mechanism, push & press to release mechanism, push-push locked type locking mechanism, or any other suitable mechanism.

The cable (208) and spring (222) are just two examples of how the instant hub (114) may be activated. In one alternative embodiment, a belt and gear mechanism may be used to fold or unfold the instant hub (114). In another alternative embodiment, a pneumatically operated mechanism can be used within the instant hub (114) that can create a force to further speed up tent assembly/disassembly. However, such a mechanism may need additional components, which may change the small footprint of the tent and ultimately affect its space utilization and storage.

Figure 3:
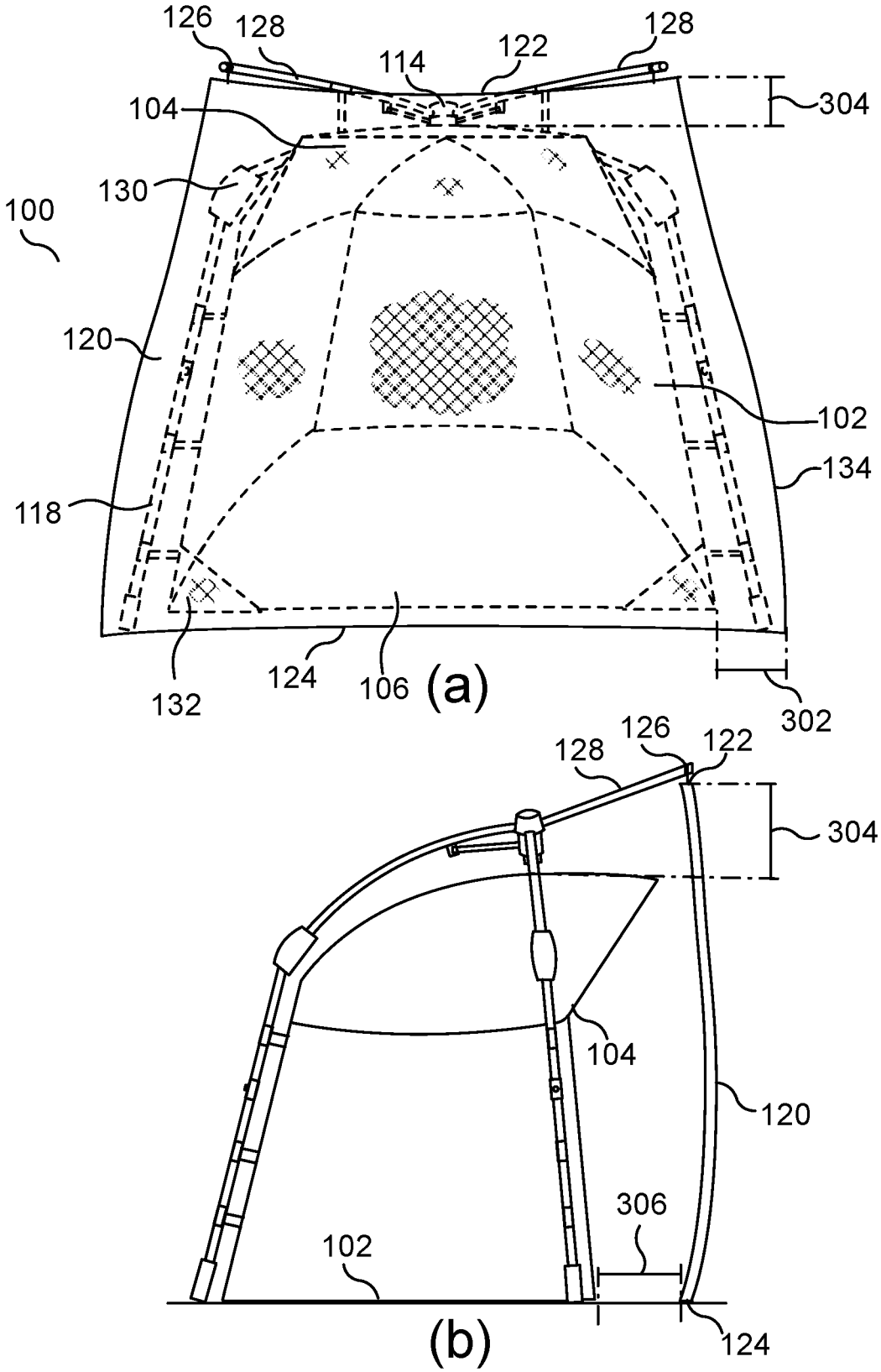
FIG. 3 illustrates front and side views of the preferred embodiment of the present disclosure comprising an instant multi-functional golf practicing tent with a single outer receiver net.

FIG. 3 illustrates front and side views of the preferred embodiment of the present disclosure comprising an instant multi-functional golf practicing tent with a single outer receiver net. All descriptions of the instant multifunctional golf practicing tent (100), frame structure, and outer receiving net (120) from FIG. 1 also apply here. Sub-figure (a) illustrates a front view of the golf practicing tent (100) with a single outer receiver net (120). The outer receiving net (120) is shown covering the entire front side of the golf practicing tent (100). Receiving net fasteners (126) are located on the left and right sides of the top end (122) of the outer receiving net (120); they are connected to the front tips of the net holding poles (128). The top end (122) of the outer receiving net (120) covers the entire instant hub (114). There is a vertical gap (304) from the top of the roof panel (104) of the tent (100) to the top edge (122) of the outer receiving net (120).

The bottom edge (124) of the outer receiving net (120) is shown to be slightly below the floor panel (106); however, this bottom edge (124) is actually in line with the floor panel (106) and the stopping pockets (132). There are two horizontal gaps (302) from the edge of the side panels (102) to the side edges (134) of the outer receiving net (120): one horizontal gap (302) from the side panel (102) on the left to the side edge (134) of the left side of the net (120); another horizontal gap (302) from the side panel (102) on the right to the side edge (134) on the right side of the net (120). The horizontal gaps (302) cover the front of the telescoping poles (118) and connecting joint members (130).

As shown in the sub-figure, the outer receiving net (120) is not constrained by the tent's (100) size and, therefore, the outer receiving net (120) can be higher and wider than the tent (100) itself. This is thanks to the exterior placement of the receiving net (120) and the modification of the two front net holding poles (128) to hold the outer receiving net (120) in such a position, where the higher and wider receiving range can be achieved.

The horizontal and vertical gaps (302, 304) are a visual representation of the wider and higher receiving range from the outer receiving net (120). As earlier noted, this allows for a safer playing environment when practicing golf. Even if a golf ball misses the tent (100) entirely, the side and top ends (122, 134) of the net (120) can still catch the ball, preventing any damage to people or properties in the surrounding area. The outer receiving net (120) itself can also lead to better performance evaluation, measuring, and tracking because of the more forgiving receiving range. In a sense, it lets users know that they need to improve so that the ball will hit its target, i.e., the tent (100).

Although not necessarily needed, extension panels can be installed on the sides of the tent (100) to work with the outer receiving net (120) in other embodiments. In a sense, they would be extensions of the side panels (102). Overall, the catching area is bigger; however, this may affect the portable form factor due to the extension panels adding to the tent's (100) footprint.

Sub-figure (b) illustrates a side view of the golf practicing tent (100) with a single outer receiver net (120). The sub-figure shows the tent's (100) front side marked along the right side of the side panel (102). The front net holding poles (128) are shown to be angled upward to allow the top end (122) of the receiving net (120) to be higher than the tent (100) itself. Naturally, the receiving net fasteners (126) are connected to the front net holding poles (128), which hold and support the outer receiving net (120). The sub-FIG. gives a clear visualization of the vertical gap (304) between the top of the roof panel (104) to the top end (122) of the outer receiving net (120). Additionally, there is a gap (306) between the bottom end (124) of the outer receiving net (120) to the tent's (100) base edge on its front side.

The gap (306) from the net's (120) bottom end (124) to the tent (100) helps the golf practicing tent (100) as a whole achieve increased strength and durability. The outer receiving net (120) receives and attenuates most of the kinetic energy from incoming golf balls. Upon contact, the energy of an incoming golf ball is weakened so that it can land on the receiving net (120) itself or be contained inside the tent (100) without damaging any of the panels, e.g., back panel or side panels (102). This will be further demonstrated in FIG. 6.

In another embodiment, the receiving net fasteners (126) can be placed anywhere along the front net holding poles (128). However, placing the outer receiving net (120) and associated net fasteners (126) too far back may cause the bottom end (124) of the receiving outer net (120) to rise up and leave an opening at the bottom of the tent (100); thus, it would affect the receiving range of the outer receiving net (120).

Yet in another embodiment of the present disclosure, in order to balance the weight of the receiving net(s) hanging far outward the front opening of the tent, extra weight is added to the back panel or back side of the floor panel. For example, a metal bar can be installed under the floor panel for weight balancing.

Figure 4:
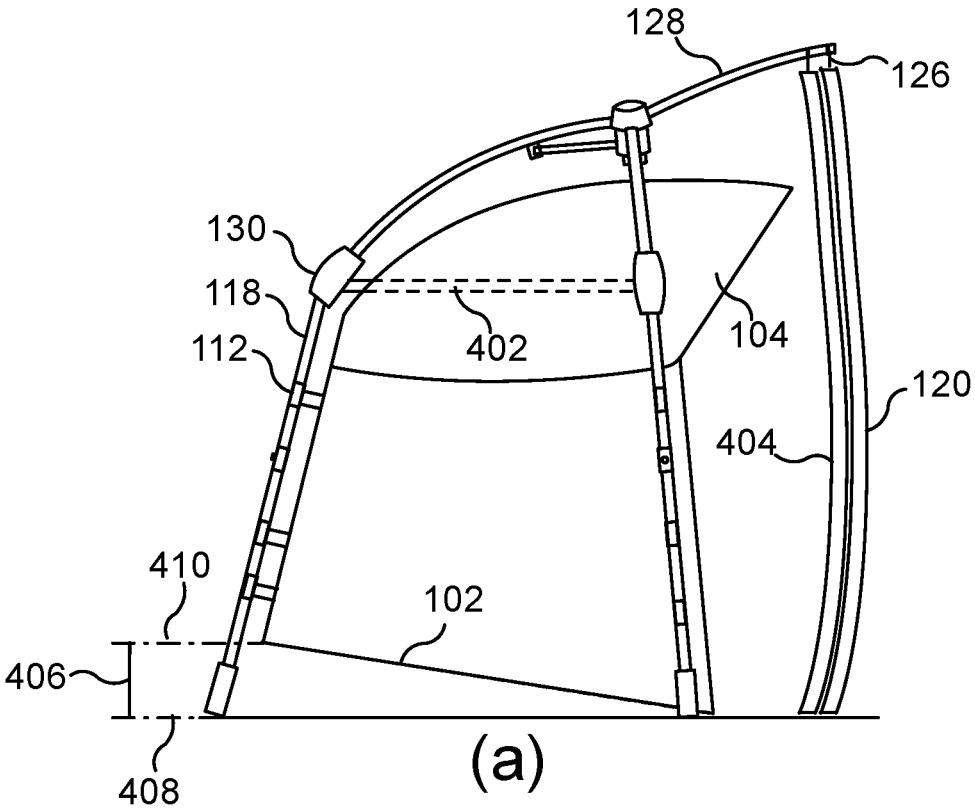
FIG. 4 illustrates side and perspective views of alternative embodiments of the instant multi-functional golf practicing tent with multiple outer receivers.
Figure 4:
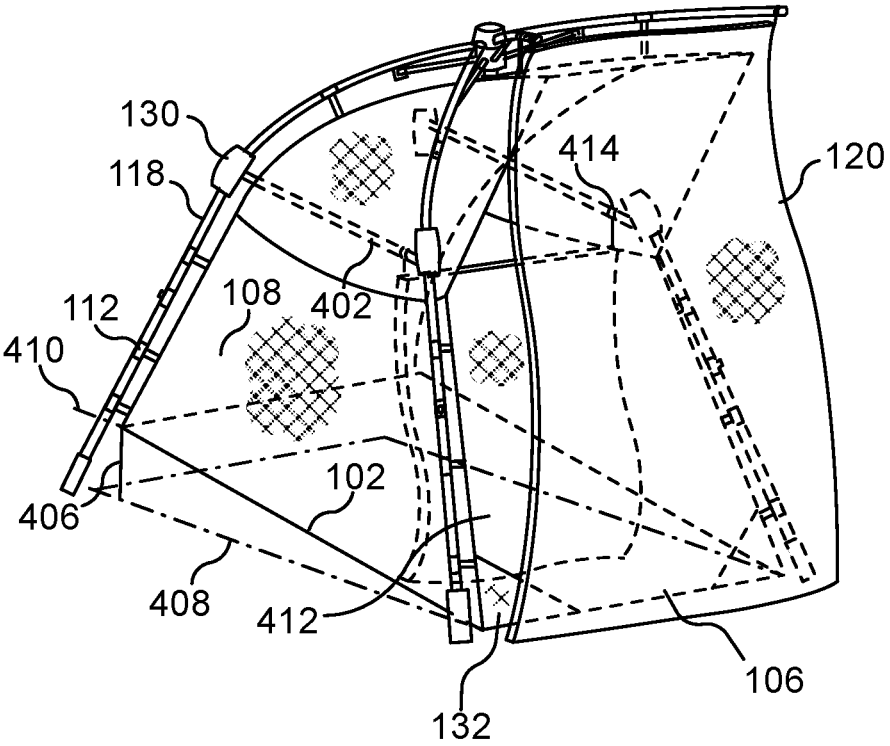

FIG. 4 illustrates side and perspective views of alternative embodiments of the instant multi-functional golf practicing tent with multiple outer receivers. Sub-figure (a) illustrates a side view of an alternative embodiment of the instant multi-functional golf practicing tent with multiple outer receivers. Specifically, there is an additional outer receiving net (404) behind the first outer receiving net (120). There can also be more than one additional outer receiving net. This additional outer receiving net (404) is also held up by receiving net fasteners (126) on the front net holding poles (128). The additional outer receiving net (404) has the same width and height as the first outer receiving net (120).

The tent itself has a few modifications compared to the preferred embodiment: first, there is a horizontal receiving net hanging rod (402) inside the tent along the length of the roof panel (104) and above the side panel (102). The receiving net hanging rod (402) is connected to two adjacent connecting joint members (130) on one side of the tent. Those skilled in the art would find it obvious that there is an additional horizontal receiving net hanging rod (402) opposite of the one seen in the sub-figure. Additionally, the tent in this embodiment has a tilted floor. This is mainly seen with the bottom of the side panels (102) elevated at an angle. The front of the tent is at ground level. The rear of the tent is raised to a tilted height (406) from the initial tent back position (408) to the raised tent back position (410). The canopy fasteners (112) at the rear of the tent are raised to different positions along their respective telescopic poles (118) to accommodate this adjustment.

Sub-figure (b) illustrates a perspective view of an alternative embodiment of the instant multi-functional golf practicing tent with multiple outer receivers. The tent has a main outer receiving net (120); however, the inside of the tent has an inner receiving net (412), which is held by inner receiving net fasteners (414) on the interior receiving net hanging rods (402). Naturally, the inner receiving net fasteners (414) are on the left and right sides of the inner receiving net's (404) top edge. The two receiving net hanging rods (402) in the tent's interior space are parallel to each other above the side panels (102) and are supported by the frame structure's connecting joint members (130). It is obvious to those skilled in the art that the size of the inner receiving net (412) is equivalent to the width and height of the tent's interior space.

The sub-figure also illustrates the tilted tent floor from the previous sub-figure. The floor panel (106) tilted in the same manner as the base sides of the side panels (102) shown in the previous sub-figures: the front edge of the floor panel (106) is in line with the stopping pockets (132) on the ground, while the back edge of the floor panel (106) is elevated to a tilted height (406). The floor panel (106) and the base of the back panel (108) move from an initial tent back position (408) to a raised tent back position (410). The back panel (108) is shortened to accommodate the tilted floor panel (106), and the canopy fasteners (112) at the rear also move up along their respective telescopic poles (118) as a result of this tilting.

Thanks to the implementation of an additional outer or inner receiving net (404, 412), the golf ball will have even less impact on the tent structure, reducing the likeliness of damage to the tent. The additional outer or inner receiving net (404, 412) adds another layer of protection to attenuate an incoming golf ball, slowing it down even further. So, even if the golf ball enters the tent, it will not hit any of the tent panels (102, 104, 106, 108) very hard, making them less likely to break. This allows the golf tent to achieve increased strength and durability.

The tilted floor panel (106) increases convenience for the user because now golf balls can roll down the floor panel (106) easily without the user needing to actively go inside the tent to retrieve them. There is a chance for the golf balls to roll away too quickly, so the stopping pockets (132) ensure that they can be caught and stored behind the stopping pockets (132) for easy retrieval at the front of the tent. More importantly, the stopping pockets (132) help ensure the balls do not bounce back at the user or anything else in the surrounding area; this makes practicing golf with the tent safer.

The receiving net hanging rods (402) inside the golf tent are shown as singular solid objects in this figure. In another embodiment, each hanging rod (402) may include a joint that allows the handing rod (402) to fold into itself to further achieve a portable form factor, leading to better space utilization and storage.

Figure 5:
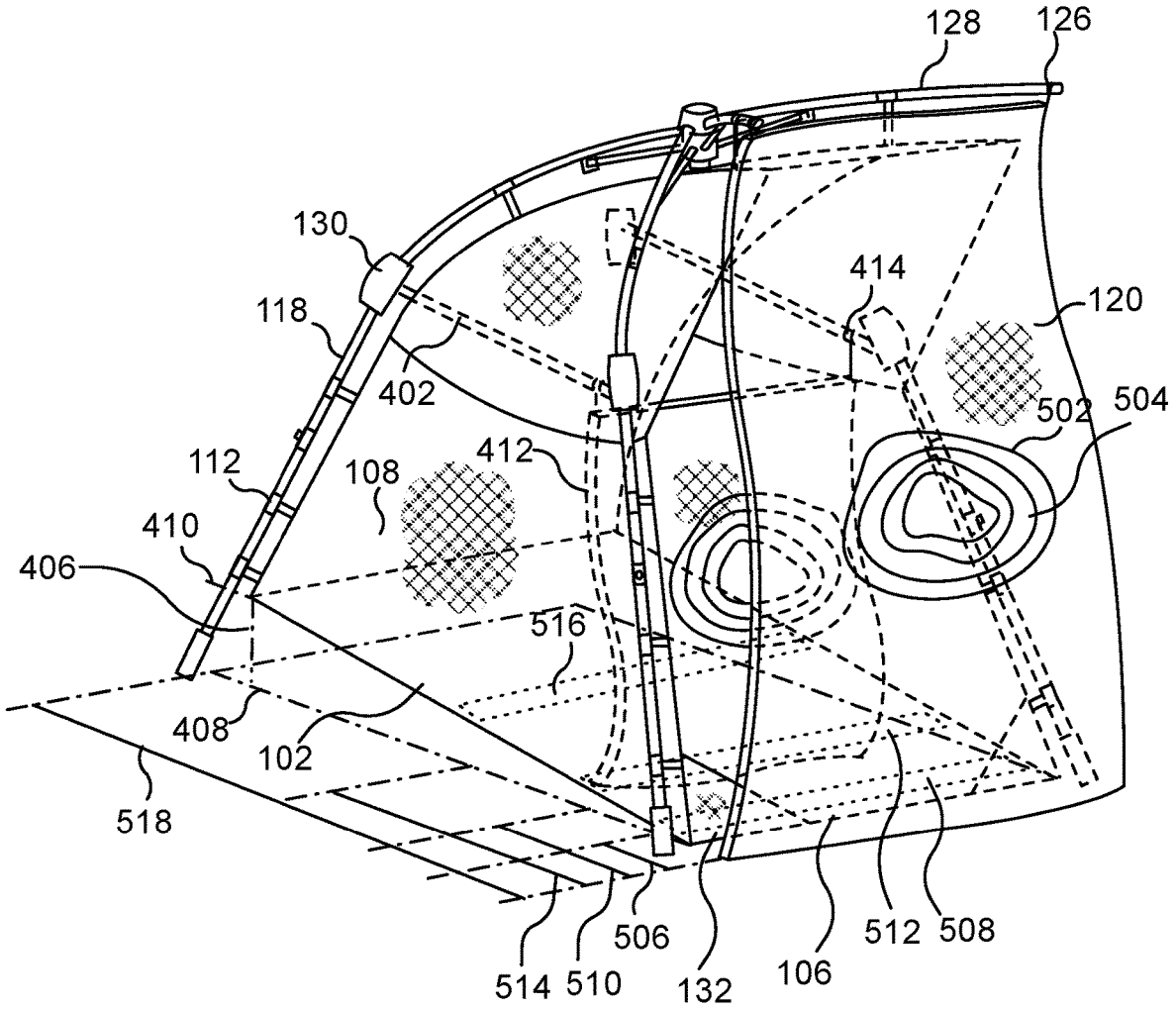
FIG. 5 illustrates a perspective view of an exemplary embodiment of the instant multi-functional golf practicing tent with outer receivers displaying measurement range maps and floor marks.

FIG. 5 illustrates a perspective view of an exemplary embodiment of the instant multi-functional golf practicing tent with outer receivers displaying measurement range maps and floor marks. All descriptions of the instant multifunctional golf practicing tent embodiment in FIG. 4(*b*) also apply here. A main outer receiving net (120) outside the tent is connected to the front net holding poles (128) via receiving net fasteners (126). An inner receiving net (412) inside the tent is connected to receiving net hanging rods (402) via inner receiving net fasteners (414). There are two interior receiving nets hanging rods (402) that are parallel to each other; they are connected to front and back joint members (130) on their respective sides. There can be more than two interior receiving nets.

Both nets (120, 412) have range maps (502) comprising of range map regions (504) in the shape of contour lines. The range maps (502) can include images of maps, pictures, or diagrams that may be used for practice. The range maps (502) may be used as a simple bullseye target to shoot a golf ball into the tent. However, the range maps (502) may also indicate different information that could reflect the user's golf performance if they played on an actual golf course. Such information reflected can include, but are not limited to: direction and distance from the hole, terrain type, weather, etc. For example, the center of the range map (502) may represent a green area, while another map region (504) can represent sand. In another example, each map region (504) may represent an imaginary line on an actual golf course, all points of which are at the same swing distance from the hole.

The floor panel (106) is angled to a tilted height (406), as shown in FIG. 4(*b*): the floor panel (106) and the base of the adjacent back panel (108) move from an initial tent back position (408) to a raised tent back position (410). To accommodate for this adjustment, the back panel (108) is shortened, and the rear canopy fasteners (112) move up along their respective telescopic poles (118).

The floor panel (106) has floor marks (508, 512, 516) at different intervals throughout its entire length from the front to the back. Each floor mark (508, 512, 516) takes the form of a marked line from one side panel (102) of the tent to the other side panel (102). The floor marks (508, 512, 516) in the FIG. comprise: a first floor mark (508) is located right at the front end of the floor panel (106) and the stopping pockets (132). The first floor mark indicates a first distance (506) from the outer receiving net (120) to the first floor mark (508); a second floor mark (512) right below the bottom edge of the inner receiving net (412). The second floor mark (512) is separated from the outer receiving net (120) by a second distance (510); a third floor mark (516) in the middle of the floor panel (106) and, by extension, the tent structure. The third floor mark (516) is separated from the outer receiving net (120) by a third distance (514). Finally, the ball can hit the back panel (108), which is unmarked and separated from the outer receiving net (120) by a fourth distance (518).

Although each floor mark (508, 512, 516) is shown in fixed positions in the sub-figure, the floor marks (508, 512, 516) can be placed anywhere along the length of the floor panel (106) in other embodiments. In yet another embodiment, the floor marks (508, 512, 516) may have numbers to indicate the actual distances (506, 510, 514, 518) from the outer receiving net (120), or they can be used to indicate the distances of a golf ball traveling in an actual golf course.

Both the floor marks (508, 512, 516) and range maps (502) are key features of the aspect that help serve as a reference when simulating a game on an actual golf course. Due to the information that can be relayed, the user has a better sense of how to improve their golf swing and stance to accommodate for various conditions on an actual golf course. As a result, better performance evaluation, measuring, and tracking can be achieved to improve one's golf performance. Thanks to the other aspects, such as the outer receiving net (120), inner receiving net (412), and stopping pockets (132), the user can truly work on their progress as a golf player without the need to worry about damaging themselves, the tent, or anything/anyone in the surrounding area.

It should be noted that the floor marks (508, 512, 516) and range maps (502) are meant for giving general information on one's golf performance. If the user desires a more precise and analytical take on their golf performance, they can use a tracking device to record their swing and translate the trajectory with a simulation software. This will be explained further in FIGS. 6 and 7.

Figure 6:
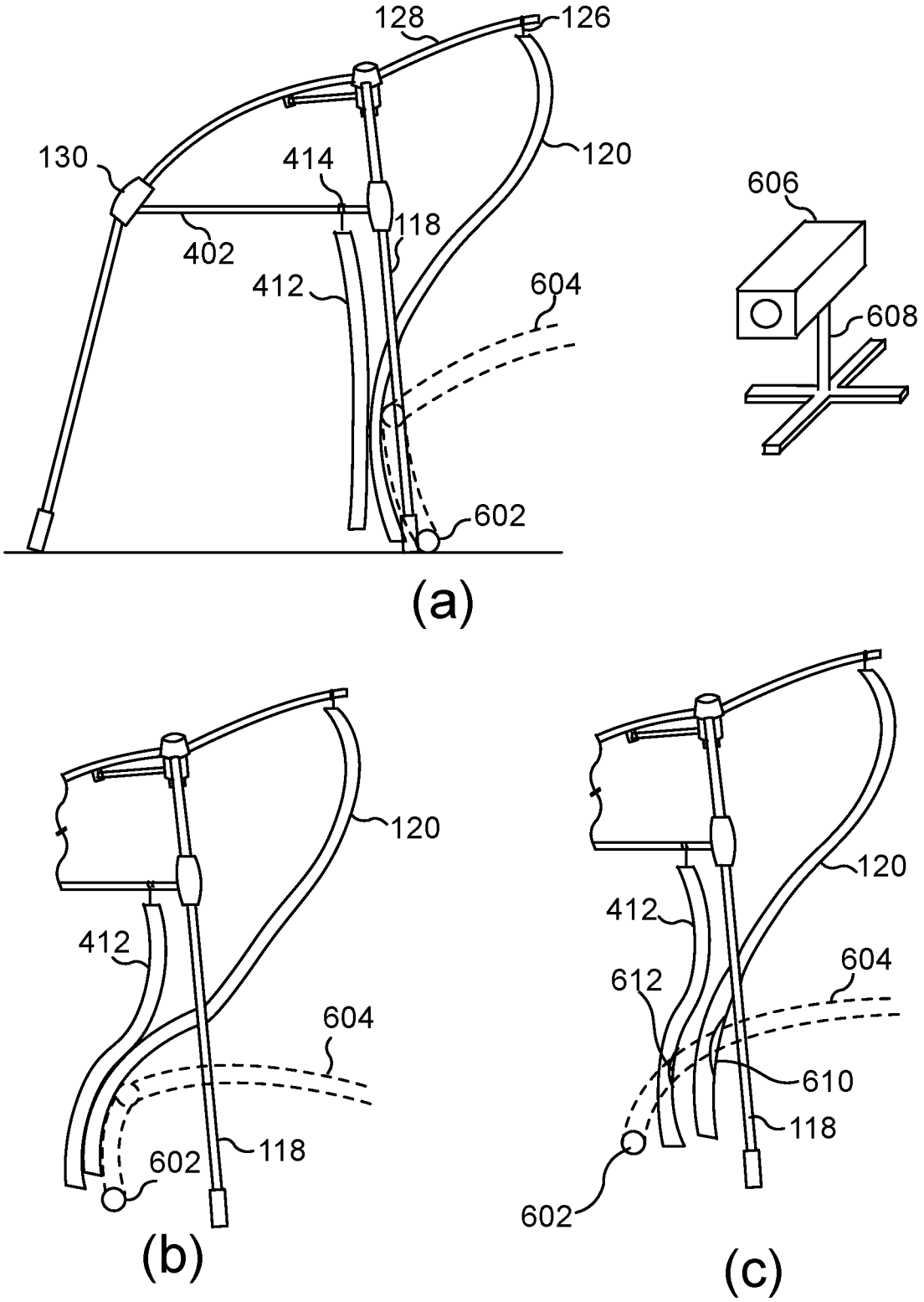
FIG. 6 illustrates side views of the alternative embodiment showing how the receiving nets work with a golf ball.

FIG. 6 illustrates side views of the alternative embodiment showing how the receiving nets work with a golf ball. Sub-figure (a) illustrates a partial side view of the embodiment shown in FIG. 5 with the golf ball (602) shot at the receiving nets (120, 412) with normal force and speed. All descriptions of the instant multifunctional golf practicing tent embodiment in FIGS. 4(*b*) and 5 also apply here. A first or main outer receiving net (120) outside the tent is connected to the front net holding poles (128) via receiving net fasteners (126). An inner receiving net (412) inside the tent is connected to interior receiving net hanging rods (402) via inner receiving net fasteners (414). The hanging rods (402) are connected to front and rear connecting joint members (130) on their respective sides.

In this sub-figure, the user shoots a ball (602) into the tent, primarily hitting the main outer receiving net (120). A tracking device (606) is deployed to record the golf ball (602) and its trajectory (604) toward the outer receiving net. A stand (608) is used to position and support the tracking device (606). The ball (602) hits the main outer receiving net (120), causing it to ripple from the impact. The ball (602) is shot with relatively normal force and travels at a typical speed; the ball trajectory (604) follows the ball (602) dropping to the ground along the front face of the main outer receiving net (120). Part of the main outer receiving net (120) ripples behind the front telescopic poles (118), making contact with the inner receiving net (412). However, the inner receiving net (412) does not ripple from the impact and stays relatively still.

Sub-figure (b) illustrates a partial side view of the embodiment shown in FIG. 5 with the golf ball shot at the receiving nets (120, 412) with an exceptionally strong force and high speed. The user shoots the golf ball (602) exceptionally hard, causing the ball (602) to hit the first outer receiving net (120) at an exceptionally high speed. The ball trajectory (604) is modified as a result. As the ball (602) hits the first outer receiving net (120), the bottom portion of the outer receiving net (120) ripples farther behind the front telescopic poles (118). This portion of the first outer receiving net (120) pushes the inner receiving net (412), causing it to ripple. Although the ball (602) travels at an exceptionally high speed, it does not go through the first outer receiving net (120). The ball (602) and ball trajectory (604) drop along the front face of the first outer receiving net (120).

Sub-figure (c) illustrates another partial side view of an alternate embodiment of the golf receiving net shown in FIG. 6*a*. Here, the first outer receiving net (120) is shown with outer receiving net holes (610). The inner receiving net (412) is shown with inner net receiving holes (612), which are smaller than the outer receiving net (120) holes. The user strikes the ball (602) into the tent, which hits the first outer receiving net (120) and causes it to ripple. Since the outer receiving net holes (610) are fairly large, the ball (602) and its trajectory (604) are shown to go through the first outer receiving net (120). The bottom portion of the first outer receiving net (120) ripples behind the telescopic poles (118) to touch the inner receiving net (412), causing it to ripple as well. The ball (602) and its trajectory (604) appear to go through the smaller inner receiving net holes (612), indicating a fairly hard swing from the user. However, the ball (602) and its trajectory (604) drop along the inner face of the inner receiving net (412).

Although the tracking device (606) is shown recording the golf ball trajectory (604) in sub-figure (a), it can also be used to record the golf ball trajectories (604) in the other sub-figures as well. In other embodiments, the stand (608) is adjustable to change the height and/or tracking angle of the tracking device (606).

Thanks to the tracking device (606), the user can improve their golf performance by seeing how they did with a recording from the tracking device (606). The tracking device (606) is typically a high-speed camera, but it can be any other applicable device in other embodiments. The tracking device (606) pairs with simulation software to translate the golf ball trajectory (604) into a simulated trajectory, showing what the user's swing would look like when playing on an actual golf course. This simulated trajectory may be an analytical calculation, or it can be a visual representation depending on the embodiment. This achieves even better performance evaluation, measuring, and tracking since it is more precise and immersive compared to the range maps and floor marks shown in FIG. 5.

The ball's (602) impact on the two receiving nets (120, 412) also contributes to a stronger and more durable golf practicing tent. The main outer receiving net (120) already absorbs much of the impact of an incoming golf ball (602). Even if the golf ball (602) is shot at the tent with such a large force to go through both receiving nets (120, 412), the ball (602) is slowed down to a point where it does not really touch the other tent panels. Instead, it would go through the inner receiving net (412). This generally shows how strength and durability are achieved since the main outer receiving net (120) absorbs much of the ball's (602) energy. Even if the ball (602) goes past both nets (120, 412), the ball (602) does not really impact the other tent panels, and therefore, is less likely to cause damage to the tent structure. Instead, the ball (602) would just drop along the rear face of the inner receiving net (412), like what is shown in sub-figure (c).

The inner and outer receiving net holes (610, 612) are shown with fixed diameters but can be made larger and smaller depending on the embodiment. Changing the diameters of the net holes (610, 612) will alter how the ball (602) hits the receiving nets (120, 412) and modify the golf ball trajectory (604).

Figure 7:
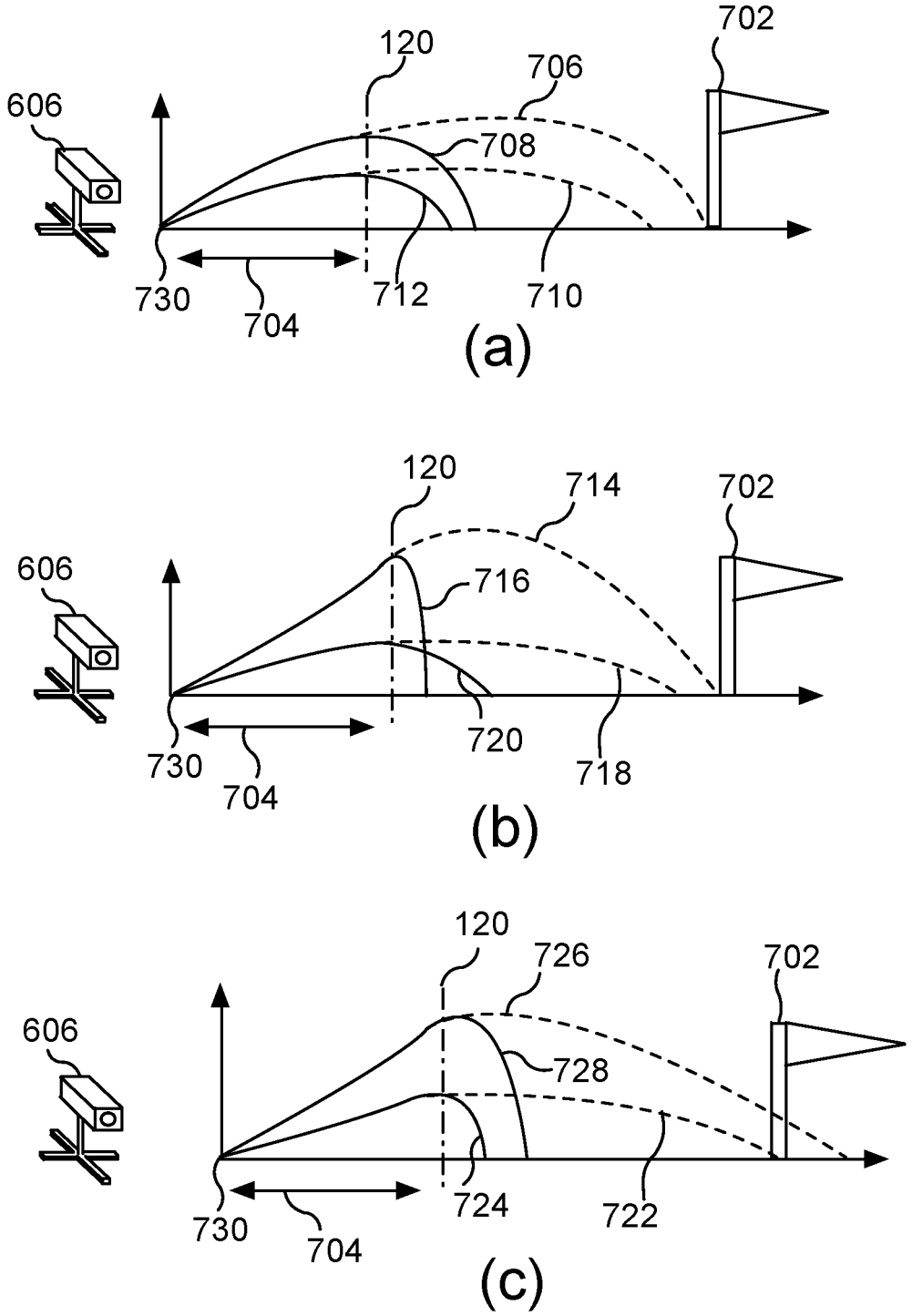
FIG. 7 illustrates how golf practicing performance gets measured and simulated through three exemplary trajectory situations.

FIG. 7 illustrates how golf practicing performance gets measured and simulated through three exemplary trajectory situations. Sub-figures (a) to (c) are all graphical representations of three exemplary trajectory situations. During simulation for all three situations, the user starts at a golf tee location (730), and the user aims to sink the ball in the golf hole (702). A tracking device (606) records the trajectory of the golf ball as it travels an actual travel distance (704) from the golf tee location (730) to the first outer receiving net (120).

Typically, in an actual golf course, the ball needs to follow estimated ball trajectories (706, 714, 722) respectively to sink into the golf hole (702). Alternatively, if the ball hits the first outer receiving net (120) with the same force as in the above scenario, the ball would instead follow actual ball trajectories (708, 716, 728), respectively. As shown in the actual ball trajectories (708, 716, 728), the ball slows down once it hits the first outer receiving net (120). Thus, if actual ball trajectories (708, 716, 728) is indicated by reading from a range map and floor markings, or if they are observed by the tracking device (606), the user or prediction software would conclude that the ball should sink into the hole (702).

In some cases, the user in a golf course may hit the ball with a different force, causing the ball to follow estimated ball trajectories (710, 718, 726), respectively. If the user hits a golf ball towards the tent's first outer receiving net (120) with the same force used in the aforementioned estimated ball trajectories (710, 718, 726), the ball would instead follow actual ball trajectories (712, 720, 724) upon hitting the tent's outer receiving net (120). The tracking device (606) would observe the actual ball trajectories (712, 720, 724) to calculate the difference between the actual distance/trajectory and the intended distance/trajectory. Normally, if a user hits a golf ball with an angle relative to the ground closer to 45-degree, the ball will fly a longer distance than another angle that is smaller or larger than it. For example, if a 45-degree angle swing can get the ball into the hole (702) in a real golf course (706, 714, 722) and (708, 716, 724) inside the tent, then another angle will miss the hole (702) in a real golf course (710, 718, 726) and (712, 720, 728) inside the tent. The ball hitting location in the range map (502) and range region (504) will reflect these estimations. In some embodiments of the present disclosure, the range map contains contour lines, range regions, images, maps, and/or diagrams, and a ball hitting position in the range map indicates a ball falling location relative to a target hole location if played on an actual golf course. For example, the ball hitting location in the range map and the center point of the range map is compared to 45-degree; wherein if the ball hitting location is closer to 45-degree, then the ball will fly over the hole; if the ball hitting location is further from 45-degree, then the ball will fly before the hole.

In another embodiment, the user may use the distance from the golf tee location (430) to where the ball stops on the tent's floor panel to represent the relative distance from the hole (702) if the ball was shot on an actual golf course. For example, a distance between (708, 716, 724) and (712, 720, 728) inside the tent can be a good estimation of the real distance between (706, 714, 722) and (708, 716, 724) in an actual golf course. For example, the ball falling location relative to the ground mark is compared to a target mark; wherein if the ball falling location is further than the target mark, then the ball will fly over the hole; if the ball falling distance is shorter than the target mark, then the ball will fly before the hole. This estimation or simulation may be done in absence of the tracking device (606).

Figure 8:
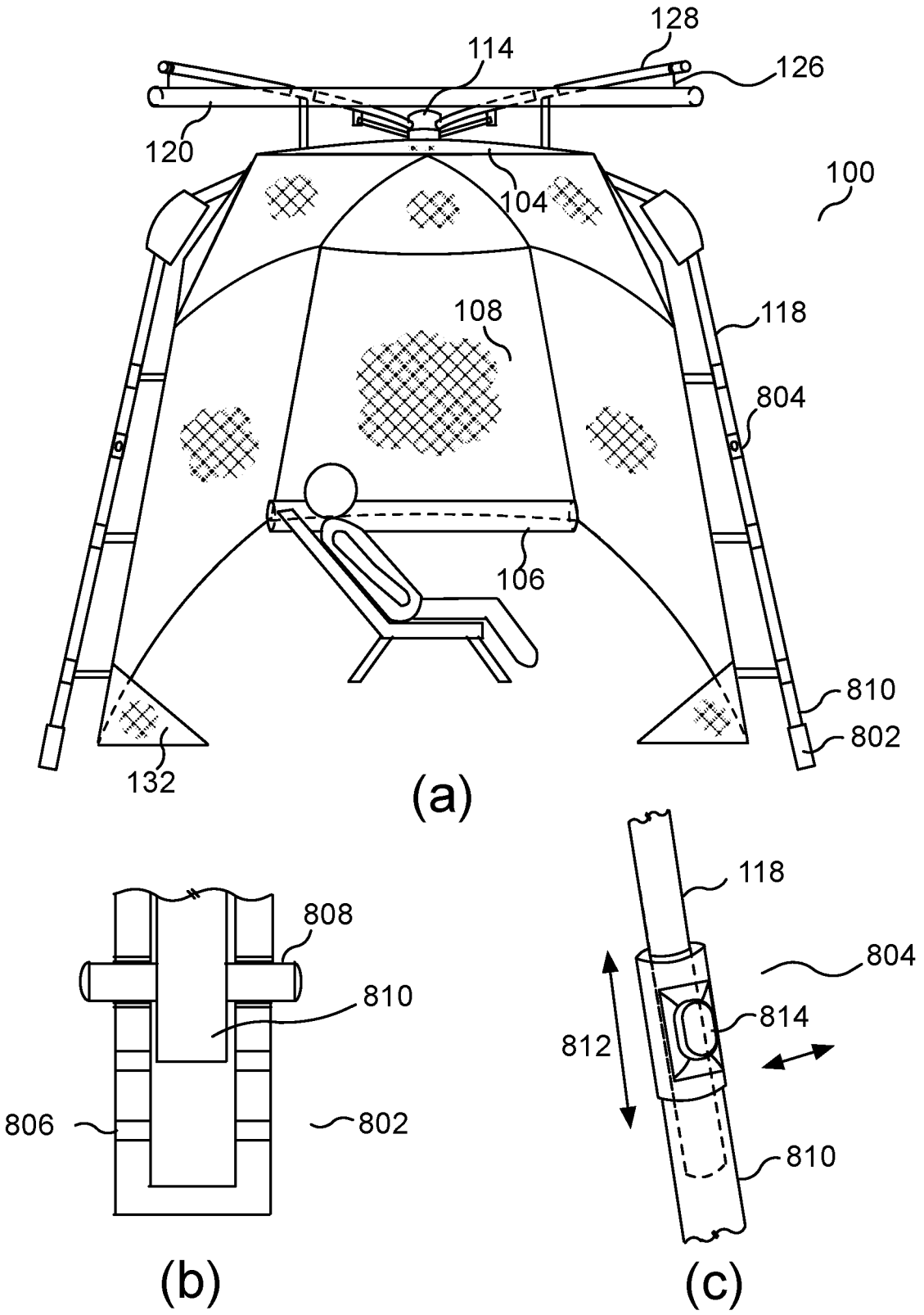
FIG. 8 illustrates front views of an embodiment of the instant golf practicing tent with an outer receiver used for alternative functions, as well as details of the extension and telescopic joint members.

FIG. 8 illustrates front views of an embodiment of the instant golf practicing tent with an outer receiver used for alternative functions, as well as details of the extension and telescopic joint members. All descriptions of the instant multifunctional golf tent (100) and its components in previous figures also apply here. Sub-figure (a) illustrates a front view of the instant golf practicing tent (100) used for an alternative function. In this sub-figure, the user is relaxing on a beach chair, so the tent (100) in this sub-figure is used as a beach tent. The user is sitting underneath the roof panel (104) of the tent (100). The floor panel (106) is rolled up in a retracted form and coupled (via stitching, Velcro, zipper, or any other suitable means) to the back panel (108). This creates an obstacle-free area within the tent (100), with the stopping pockets (132) staying in place to act as a sort of boundary. The outer receiving net (120) is also rolled up in a retracted form to the front net holding poles (128) and can be held up in that form with Velcro, string, or any other suitable means.

The telescopic poles (118) can be adjusted in length to accommodate different elevations. Each telescopic pole (118) comprises two sections separated by a telescopic joint member (804): an upper section with the actual telescopic pole (118) above the telescopic joint member (804); a lower section comprising an extension pole (810) below the telescopic joint member (804) that covers the lower section of the telescopic pole (118). The telescopic poles (118) extend from or retract into their respective extension poles (810). Extension members (802) are located at the base of the extension poles (810) and the tent's (100) frame structure; each extension member (802) can receive the lower end of their respective extension pole (810). Details regarding the extension member (802) and the telescopic joint member (804) are further described in the following sub-figures.

The golf tent (100) in this sub-figure is shown to act as a beach tent. The golf tent (100) can function in various other ways, including a camp tent, event tent, picnic tent, vocational shelter, storage space, etc. Because of the myriad of indoor and outdoor uses, the golf tent (100) can achieve increased adaptability. This is also aided by the golf tent's (100) ability to be packed into a portable form factor to be carried anywhere.

The sub-figure shows only the floor panel (106) and outer receiving net (120) retracting into a small form factor. Other tent sections, like the back panel (108), roof panel (104), and stopping pockets (132), can fold up to aid the portable form factor aspect of the golf tent (100). This may further achieve improved space utilization and storage.

Sub-figure (b) illustrates a front cross-sectional view of an extension member (802) at the base of the tent's (100) frame structure, particularly at the base of an extension pole (810). The extension member (810) has a hollow, tubular-shaped body. Along the body of the extension member (802) are a pair of opposing holes (806). Each of the opposing holes (806) can receive a pin (808) on the lower end of the extension pole (810). The pin (808) can be adapted to move inward when inward forces are applied to it and are adapted to return to its original position when such forces are removed. In operation, the forces applied to the pin (808) move said pin (808) inward so that it can clear the body of the extension member (810). As a result, the extension pole (810) can move between the sets of holes (806) on the body of the extension member (802). After the extension pole (810) is in the preferred position, and the pin (808) aligns with a corresponding set of holes (806), the inward forces can be removed from the pin (808), allowing the pin (808) to return to their original position and lock the extension pole (810) in place within the extension member (802).

Sub-figure (c) illustrates a detailed view of a telescopic joint member (804). The telescopic joint member (804) is a cylindrical body that has a push button (814). The extension pole (810) is connected below the telescopic joint member (804). The telescopic pole (118) above the telescopic joint member (804) travels in a telescopic direction (812), extending from or retracting into the respective joint member (804) and the respective extension pole (810). This movement in a telescopic direction (812) happens when the push button (814) is held down by the user. When the user releases the push button (814), the telescopic pole (118) locks in place.

In this embodiment, the telescopic pole (118) is shown as an inner member, while the extension pole (810) is shown as an outer member. In another embodiment, the telescopic pole (118) is shown as an outer member, while the extension pole (810) is shown as an inner member that retracts or extends.

The extension members (802) and telescopic joint members (804) allow the user to adjust the lengths of the telescopic poles (118) and extension poles (810) depending on the user's preference. This allows the golf tent (100) to achieve the portable form factor, making the tent (100) components easier to pack and store. Furthermore, each telescopic pole (118) and their respective extension pole (810) can individually adjust to position the tent's (100) frame structure in various ways. With these adjustments, the tent (100) can be tilted forward, backward, or sideways. Such adjustments are particularly helpful when the tent (100) is positioned on a sloped or uneven surface. As a result, the tent (100) is further able to achieve adaptability in even more environments.

The extension members (802) and the telescopic joint members (804) are manual in the present disclosure, requiring the user to press their corresponding pins (808) or push buttons (814), respectively. In another embodiment, these components (802, 804) can be electronic and operate automatically. This will achieve increased convenience since the user can just activate the telescopic pole (118) and extension pole (810) adjustments with a push of a button; however, this may require extra components that could affect the portable form factor of the tent (100). In other embodiments, the extension members (802) and the telescopic joint members (804) may be composed of a flexible material such as plastic, polymers, metal, alloys, ceramic, carbon fibers, or any other suitable material.

The terms and expressions which have been employed herein as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

The invention claimed is:

1. A multifunctional golf practicing and camping tent, comprising:

a roof panel, a floor panel, a back panel, and two opposing side panels forming a front opening; wherein the back panel and the side panels are supported by telescopic poles;

a collapsible frame structure including an instant hub that comprises a hub's cylinder, two front net holding poles, a plurality of hub poles and moving poles, and an actuation mechanism configured to be activated by a pull of a cable pulley or by a spring, wherein the activation mechanism causes the instant hub to expand outward from or retract inward into a compact configuration such that the hub poles and moving poles are aligned with the hub's cylinder;

a first receiving net positioned outside the front opening and spaced apart therefrom, the first receiving net having a top end secured to the two front net holding poles via receiving net fasteners at respective left and right corners of the top end, wherein the top end is located vertically beyond the roof panel, and the first receiving net further comprises:

a lower end that extends loosely toward the floor panel; and side ends that extend laterally beyond the telescopic poles on the left and right sides of the tent;

a second receiving net disposed inside the front opening; the second receiving net having a top end attached to the frame structure and configured to receive golf balls that either rebound off or pass through the first receiving net via the first receiving net holes, and a lower end extending loosely toward the floor.

2. The tent of claim 1, further comprising: a range map printed on the first receiving net, containing contour lines, range regions, and/or diagrams; wherein the range map's ball-hitting position simulates ball trajectory and falling location relative to a target hole on an actual golf course.

3. The tent of claim 2, further comprising: floor distance marks on the floor panel indicating estimated travel distances of golf balls relative to the target hole in the actual golf course.

4. The tent of claim 3, wherein a tracking device comprising a high-speed camera records the golf ball's trajectory, hitting position on the range map, and dropping location on the floor panel; a simulation processes the recorded data to estimate the golf balls' travel distance and performance on the actual golf course.

5. The tent of claim 1, wherein the floor panel is tilted downward toward the front opening to facilitate easy retrieval of golf balls.

6. The tent of claim 1, wherein at least one corner of the tent includes a triangular stopping pocket along the floor panel to prevent golf balls from flying out of the tent and to aid golf ball collection.

7. The tent of claim 1, wherein the first receiving net and the second receiving net have changeable net hole sizes for accommodating varying levels of golf practice intensity.

8. The tent of claim 1, wherein the collapsible frame structure includes weighted back supports to balance the weight of the first receiving net.

9. The tent of claim 1, wherein the first receiving net is detachably mounted to the frame for portability and ease of replacement.

10. The tent of claim 1, further comprising a third receiving net disposed inside the front opening so that the second receiving net is between the first and third receiving nets to absorb excess impact from golf balls rebound off or pass through the second receiving net.

11. The tent of claim 1, wherein the roof panel includes ventilation holes to facilitate airflow during golf practice or camping.

12. The tent of claim 1, wherein the telescopic poles and/or the front net holding poles are composed of strong yet flexible materials including plastic, polymers, aluminum, fiberglass, wood, metal, alloys, ceramic, and carbon fibers.

13. The tent of claim 3, wherein the simulation evaluates golf performance after the golf ball impacts the first receiving net by (a) comparing the golf ball hitting location in the range map to a target mark relative to a 45-degree reference location, (b) comparing the golf ball falling location on the tent's floor panel relative to reference floor distance marks that estimate whether the golf ball would have flown over, before, or into the target hole, or both (a) and (b); wherein if the golf ball hitting location and/or falling location matches the reference, the golf ball is determined to have sunk into the target hole; if closer to the reference, then the golf ball would have flown before the target hole; and if further away, then the golf ball would have flown over the target hole.

14. The tent of claim 4, wherein the simulation evaluates golf performance after the golf ball impacts the first receiving net by analyzing the golf ball's trajectory recorded by a tracking device to compare what simulated trajectory the user's swing would produce on an actual golf course relative to the target hole; wherein the simulated trajectory is an analytical calculation or a visual representation.

15. The tent of claim 4, wherein the tracking device integrates with a user interface to provide real-time trajectory feedback and performance analysis.

16. A method of using a multifunctional tent for golf practice, comprising:

assembling the tent with a roof panel, a floor panel, a back panel, and two opposing side panels forming a front opening; wherein the back panel and the side panels are supported by telescopic poles; wherein floor distance marks are printed on the floor panel to indicate estimated travel distances of a golf ball relative to a target hole in an actual golf course;

providing a collapsible frame structure including an instant hub that comprises a hub's cylinder, two front net holding poles, a plurality of hub poles and moving poles, and an actuation mechanism configured to be activated by a pull of a cable pulley or by a spring, wherein the activation mechanism causes the instant hub to expand outward from or retract inward into a compact configuration such that the hub poles and moving poles are aligned with the hub's cylinder;

installing a first receiving net positioned outside the front opening and spaced apart therefrom, the first receiving net having a top end secured to the two front net holding poles via receiving net fasteners at respective left and right corners of the top end, wherein the top end is located vertically beyond the roof panel, and the first receiving net further comprises:

a lower end that extends loosely toward the floor;

side ends that extend laterally beyond the telescopic poles on the left and right sides of the tent;

a printed range map containing contour lines, range regions, and/or diagrams;

installing a second receiving net disposed inside the front opening; the second receiving net having a top end attached to the frame structure and configured to receive golf balls that either rebound off or pass through the first receiving net via the first receiving net holes, and a lower end extending loosely toward the floor panel;

practicing golf by hitting the golf ball toward the first receiving net;

evaluating the golf practice by measuring the golf ball falling location relative to the printed range map on the first receiving net, the second receiving net, and the floor distance marks on the floor panel to simulate ball trajectory and falling location relative to the target hole on the actual golf course.

17. The method of claim 16, wherein the simulation evaluates golf performance after the golf ball impacts the first receiving net by (a) comparing the golf ball hitting location in the range map to a target mark relative to a 45-degree reference location, (b) comparing the golf ball falling location on the tent's floor panel relative to reference floor distance marks that estimate whether the golf ball would have flown over, before, or into the target hole, or both (a) and (b); wherein if the golf ball hitting location and/or falling location matches the reference, the golf ball is determined to have sunk into the target hole; if closer to the reference, then the golf ball would have flown before the target hole; and if further away, then the golf ball would have flown over the target hole.

18. The method of claim 16, further comprising capturing and recording the golf ball's trajectories using a tracking device, including a high-speed camera and analyzing the data with a simulation software; wherein the simulation software evaluates golf performance after the golf ball impacts the first receiving net by analyzing the golf ball's trajectory recorded by the tracking device to compare what simulated trajectory the user's swing would produce on an actual golf course relative to the target hole; wherein the simulated trajectory is an analytical calculation or a visual representation; wherein the tracking device integrates with a user interface to provide real-time trajectory feedback and performance analysis.

19. The method of claim 16, wherein the floor panel is tilted downward toward the front opening to facilitate easy retrieval of golf balls; wherein at least one corner of the tent includes a triangular stopping pocket along the floor panel to prevent golf balls from flying out of the tent and to aid ball collection; wherein the first receiving net and the second receiving net have changeable net hole sizes for accommodating varying levels of golf practice intensity; wherein the collapsible frame structure includes weighted back supports to balance the weight of the first receiving net; wherein the first receiving net is detachably mounted to the frame for portability and ease of replacement.

20. The method of claim 16, further comprising installing a third receiving net disposed inside the front opening so that the second receiving net is between the first and third receiving nets to absorb excess impact from golf balls rebound off or pass through the second receiving net.

* * * * *